US009500031B2

(12) United States Patent
Coull et al.

(10) Patent No.: US 9,500,031 B2
(45) Date of Patent: Nov. 22, 2016

(54) ROTARY STEERABLE DRILLING APPARATUS

(71) Applicants: David A. Coull, Montrose (GB); Malcolm George Vie, Montrose (GB)

(72) Inventors: David A. Coull, Montrose (GB); Malcolm George Vie, Montrose (GB)

(73) Assignee: APS Technology, Inc., Wallingford, CT (US)

( * ) Notice: Subject to any disclaimer, the term of this patent is extended or adjusted under 35 U.S.C. 154(b) by 640 days.

(21) Appl. No.: 13/674,872

(22) Filed: Nov. 12, 2012

(65) Prior Publication Data

US 2014/0131106 A1 May 15, 2014

(51) Int. Cl.
*E21B 7/06* (2006.01)
*E21B 17/20* (2006.01)
*E21B 7/04* (2006.01)

(52) U.S. Cl.
CPC ..... *E21B 7/04* (2013.01); *E21B 7/062* (2013.01); *E21B 7/067* (2013.01); *E21B 17/20* (2013.01)

(58) Field of Classification Search
CPC ..... E21B 7/06; E21B 7/062; E21B 7/067; E21B 17/20
See application file for complete search history.

(56) References Cited

U.S. PATENT DOCUMENTS 2,906,143 A 9/1959 Muser
2,919,897 A 1/1960 Sims
3,062,303 A 11/1962 Schultz
3,092,188 A 6/1963 Farris
3,650,338 A 3/1972 McNeely
3,825,081 A 7/1974 McMahon
(Continued)

FOREIGN PATENT DOCUMENTS

EP 0 409 446 A1 1/1991
EP 0 467 335 B1 1/1992
(Continued)

OTHER PUBLICATIONS

International Application No. PCT/US2013/069054; International Search Report dated Apr. 23, 2014, 15 pages.
(Continued)

*Primary Examiner* — Giovanna C Wright
(74) *Attorney, Agent, or Firm* — Baker & Hostetler LLP

(57) ABSTRACT

A rotary steering apparatus for a drill string in which a bending section induces a bend in a portion of the bottom hole assembly of the drill string by using the rotation of the drive shaft that drives the drill bit during normal drilling, while operating at a reduced or zero drilling mud flow rate, to drive a reduction gear that rotates a nut or cam so as to place a tension tube into tension. The tension tube abuts a flexible housing and places the flexible housing in compression. The flexible housing has a local weakening formed in it that causes it to preferentially bend in a predetermined direction. Compression in the flexible housing causes the housing to bend, which bends a portion of the bottom hole assembly so as to alter the direction of drilling. Rotation of the drive shaft at reduced or zero mud flow rate also causes the drive shaft to drive rotation of a second reduction gear the output of which rotates the bent portion of the bottom hole assembly thereby altering its tool face angle.

73 Claims, 19 Drawing Sheets

(56) References Cited

U.S. PATENT DOCUMENTS

| | | | | |
|---|---|---|---|---|
| 3,903,974 | A * | 9/1975 | Cullen | E21B 7/068 166/297 |
| 4,076,084 | A | 2/1978 | Tighe | |
| 4,185,704 | A | 1/1980 | Nixon, Jr. | |
| 4,220,213 | A | 9/1980 | Hamilton | |
| 4,305,474 | A | 12/1981 | Farris | |
| 4,319,649 | A | 3/1982 | Jeter | |
| 4,343,369 | A * | 8/1982 | Lyons | E21B 17/20 175/61 |
| 4,638,873 | A | 1/1987 | Welborn | |
| 4,732,223 | A * | 3/1988 | Schoeffler | E21B 7/062 175/256 |
| 4,739,843 | A | 4/1988 | Burton | |
| 5,038,872 | A | 8/1991 | Shirley | |
| 5,040,619 | A | 8/1991 | Jordan | |
| 5,131,479 | A | 7/1992 | Boulet | |
| 5,186,264 | A | 2/1993 | deChaffaut | |
| 5,213,168 | A | 5/1993 | Warren | |
| 5,220,963 | A | 6/1993 | Patton | |
| 5,311,953 | A | 5/1994 | Walker | |
| 5,316,093 | A | 5/1994 | Morin | |
| 5,318,138 | A | 6/1994 | Dewey | |
| 5,423,389 | A | 6/1995 | Warren | |
| 5,484,029 | A | 1/1996 | Eddison | |
| 5,490,569 | A | 2/1996 | Brotherton | |
| 5,529,133 | A | 6/1996 | Eddison | |
| 5,875,859 | A | 3/1999 | Ikeda | |
| 5,941,321 | A | 8/1999 | Hughes | |
| 5,979,570 | A | 11/1999 | McLoughlin | |
| 6,050,346 | A | 4/2000 | Hipp | |
| 6,089,332 | A | 7/2000 | Barr | |
| 6,102,681 | A | 8/2000 | Turner | |
| 6,105,690 | A | 8/2000 | Biglin, Jr. | |
| 6,216,802 | B1 | 4/2001 | Sawyer | |
| 6,230,823 | B1 | 5/2001 | Sieniawski | |
| 6,244,361 | B1 | 6/2001 | Comeau | |
| 6,257,356 | B1 | 7/2001 | Wassell | |
| 6,321,857 | B1 | 11/2001 | Eddison | |
| 6,328,119 | B1 | 12/2001 | Gillis | |
| 6,392,561 | B1 | 5/2002 | Davies | |
| 6,427,783 | B2 | 8/2002 | Krueger | |
| 6,595,303 | B2 | 7/2003 | Noe | |
| 6,626,254 | B1 | 9/2003 | Krueger | |
| 6,659,200 | B1 | 12/2003 | Eppink | |
| 6,714,138 | B1 | 3/2004 | Turner | |
| 6,808,027 | B2 | 10/2004 | McLoughlin | |
| 6,913,095 | B2 | 7/2005 | Krueger | |
| 7,013,994 | B2 | 3/2006 | Eddison | |
| 7,327,634 | B2 | 2/2008 | Perry | |
| 7,389,830 | B2 | 6/2008 | Turner | |
| 7,681,663 | B2 | 3/2010 | Cobern | |
| 7,762,356 | B2 | 7/2010 | Turner | |
| 2004/0016571 | A1 | 1/2004 | Krueger | |
| 2004/0262043 | A1 | 12/2004 | Schuaf | |
| 2006/0215491 | A1 | 9/2006 | Hall | |
| 2006/0260843 | A1 | 11/2006 | Cobern | |
| 2010/0032212 | A1 * | 2/2010 | Van Steenwyk | E21B 7/067 175/61 |

FOREIGN PATENT DOCUMENTS

| | | | |
|---|---|---|---|
| EP | 0530045 | A1 | 3/1993 |
| EP | 0540045 | A1 | 5/1993 |
| EP | 0 577 845 | B1 | 1/1994 |
| EP | 0770760 | A1 | 5/1997 |
| EP | 0874128 | A2 | 10/1998 |
| EP | 0904478 | B1 | 8/2000 |
| EP | 1354120 | B1 | 7/2008 |
| GB | 2259316 | A | 3/1998 |
| GB | 2343470 | A | 5/2000 |
| GB | 2408526 | A | 6/2005 |
| GB | 2410042 | A | 7/2005 |
| GB | 2 427 222 | A | 12/2006 |
| WO | WO9631679(A1) | | 10/1996 |
| WO | WO 97/47848 | | 12/1997 |
| WO | WO0104453(A1) | | 1/2001 |
| WO | WO 01/25586 | A1 | 4/2001 |
| WO | WO 01/46549 | A1 | 6/2001 |
| WO | WO0151761(A1) | | 7/2001 |
| WO | WO 2002/059447 | A1 | 8/2002 |
| WO | WO 03/076760 | A2 | 9/2003 |
| WO | WO 2005/028805 | A1 | 3/2005 |
| WO | WO 2009/129386 | A2 | 10/2009 |

OTHER PUBLICATIONS

Durant, Slimhole Rotary Steerable System Now a Reality, Drilling Contractor, Jul. Aug. 2002_pp. 24-25.

Catalog. Schlumberger, Power Drive Vortex, Rotary Steerable System for Supercharged Drilling, Mar. 2005, 5 pgs.

Catalog. Schlumberger, Power Drive Xtra Series, Complete Series of Rotary Steerable Systems for Reduced Well Construction Cost, Oct. 2002, 7 pgs.

Schlumberger, PowerDrive Xtra 475 Rotary Steerable System, SMP.5897.1_connect.slb.com, Dec. 2002, 2 pgs.

Schlumberger, Statoil Saves Big with New Rotary Steerable System, Drilling Contractor, Mar. Apr. 2004, p. 44.

In the United States Patent and Trademark Office, in Re: U.S. Appl. No. 11/117,802 Non-Final Office Action dated May 15, 2007.

* cited by examiner

ROTARY STEERABLE DRILLING APPARATUS

TECHNICAL FIELD

The present invention relates to underground drilling. More specifically, the invention relates to a system for steering a rotating drill bit as the drill bit forms a bore hole in an earthen formation.

BACKGROUND

Underground drilling, such as gas, oil, or geothermal drilling, generally involves drilling a bore through a formation deep in the earth. Such bores are formed by connecting a drill bit to long sections of pipe, referred to as a "drill pipe," so as to form an assembly commonly referred to as a "drill string." The drill string extends from the surface, to the bottom of the bore.

The drill bit is rotated so that the drill bit advances into the earth, thereby forming the bore. In a drilling technique commonly referred to as rotary drilling, the drill bit is rotated by rotating the drill string at the surface. In other words, the torque required to rotate the drill bit is generated above-ground, and is transferred to the drill bit by way of the drill string.

Drilling mud is a high pressure fluid that is pumped from the surface, through an internal passage in the drill string, and out through the drill bit. The drilling mud lubricates the drill bit, and flushes cuttings from the path of the drill bit. The drilling mud then flows to the surface through an annular passage formed between the drill string and the surface of the bore.

The drill bit can also be rotated by a mud motor driven by the flow of drilling fluid. The mud motor is usually mounted in the drill string, proximate the drill bit. The drill bit can be rotated by the mud motor alone, or by rotating the drill string while operating the mud motor.

So called "smart" drilling systems include sensors located down hole in the drill string. The information provided by these sensors permits the drill string operator to monitor relevant properties of the geological formations through which the drill bit penetrates. Based on an analysis of these properties, the drilling operator can decide to guide the drill string in a particular direction. In other words, rather than following a predetermined trajectory, the trajectory of the drill string can be adjusted in response to the properties of the underground formations encountered during the drilling operation. The technique is referred to as "geosteering."

Various techniques have been developed for performing both straight hole and directional (steered) drilling without a need to reconfigure the bottom hole assembly of the drill string, i.e., the equipment located at or near the down-hole end of the drill string. For example, so called steerable systems use a mud motor with a bent housing. In such systems, the drill string is operated in a sliding mode in which the drill string is not rotated. Rather, the drill bit is rotated exclusively by the mud motor. The bent housing or subassembly steers the drill bit in the desired direction as the drill string slides through the bore, thereby effectuating directional drilling In prior art steerable system, the tool face angle of the bent housing could be adjusted from the surface by rotating the drill string, which reorients a scribe line whose position relative to the bend is known thereby allowing the operator to determine the amount of change in the tool face angle of the bent housing. However, unless the bottom hole assembly is pulled out of the bore hole and the bent housing removed when straight ahead drilling is desired, the use of the bent housing results in drilling an oversize bore hole when it is desired to return to straight drilling by rotating the drill string. Moreover the severity of the dog leg—that is, the degree of change in the angle of drilling—cannot be adjusted from the surface and requires pulling the bent housing out of the bore hole.

Other approaches to directional drilling, such as those described in U.S. Pat. Nos. 6,321,857 and 7,013,994, use cam surfaces or eccentric stabilizers, together with an eccentric mass, to induce an offset in the drill bit that alters the direction of drilling. Although the direction of drilling can be altered from the surface by rotating a mandrel that normally drives the drill bit to instead rotate the cam surface or eccentric stabilizers, the degree of the change in the drilling direction provided by the offset cannot be altered in such systems without pulling the drill string from the bore hole and changing the components. Nor can straight ahead drilling be accomplished without pulling the drill string from the bore hold and removing the directional drilling apparatus.

Other directional drilling systems, such as those disclosed in U.S. Pat. No. 7,762,356 (Turner et al), allow the direction of drilling, as well as the degree of change in the drilling direction, to be altered based on commands from the surface, without removing the drill string, by controlling the extension of members radially outward from the drill string that contact the side of the bore hole wall, for example once per revolution, so as to deflect the drill bit. However, such systems are complex and require precise control of the mechanism for extending the members that contact the bore hole wall.

Consequently, a need exists for an improved drilling system in which the change in the direction of drilling, including the degree of change in the drilling direction, can be effected from the surface, without removal of the drill string from the bore hole.

SUMMARY

In one embodiment, the invention concerns an apparatus for steering a drill bit used to drill a bore hole in an earthen formation and in which the apparatus forms a portion of a bottom hole assembly of a drill string to which the drill bit is coupled. In such embodiment the steering apparatus comprises: (a) a bendable member adapted to be incorporated into the bottom hole assembly, the bendable member having a preferential direction in which the bendable member bends, wherein the amount of bending of the bendable member in the preferential direction determines the degree of change in the direction of the drilling; (b) means for adjusting in situ the amount of the bending of the bendable member in the preferential direction so as to adjust the degree of directional change in the drilling; and (c) means for adjusting in situ the tool face angle of the bendable member so as to adjust the direction of the drilling. In one embodiment, the bendable member bends in the preferential direction as a result of the application of a force, such as a compressive force, to the bendable member. The bendable member may comprise a flexible housing having at least one weakening feature incorporated into the housing.

The invention also concerns an apparatus for steering a drill bit used to drill a bore hole in an earthen formation comprising: (a) a bendable member adapted to be incorporated into the bottom hole assembly of a drill string to which the drill bit is coupled, the bendable member having a preferential direction in which the bendable member bends when a force is applied to the bendable member, wherein the amount of bending of the bendable member in the preferential direction determines the degree of change in the direction of the drilling; (b) a force applying member adapted to be mounted in the bottom hole assembly so that displacement of the force applying member applies a force to the bending member that bends the bendable member in the preferential direction; (c) a reduction gear coupled to the drive shaft and the force applying member so that rotation of the reduction gear by the drive shaft causes the displacement of the force applying member that applies the force to the bendable member that bends the bending member in the preferential direction.

According to another embodiment, the invention concerns a method of steering a drill bit coupled to a drill string having a bottom hole assembly and drilling a bore hole into an earthen formation. In such embodiment, the method may comprise the steps of: (a) rotating the drill bit so as to drill the bore hole into the earthen formation in a first direction by rotating a drive shaft coupled to the drill bit and extending through the bottom hole assembly while simultaneously pumping a drilling fluid through the drill string at a first flow rate; (b) changing the direction in which the drill bit drills the bore hole, wherein: (i) the direction in which the drill bit drills is effected by bending at least a first portion of the bottom hole assembly; and (ii) the first portion of the bottom hole assembly is effected by rotating the drive shaft while pumping the drilling fluid through the drill string at a second flow rate lower than said first flow rate.

DETAILED DESCRIPTION OF ILLUSTRATIVE EMBODIMENTS

Figure 1:
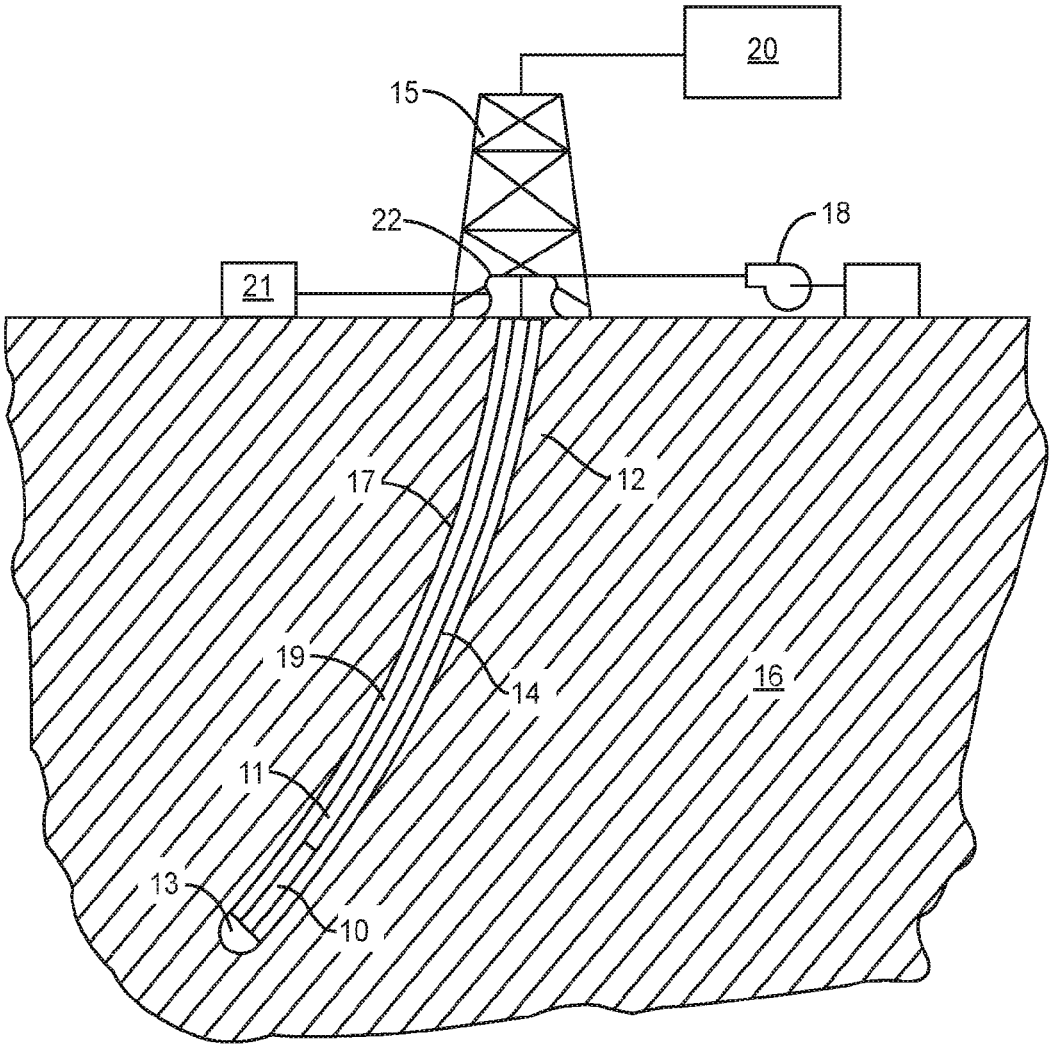
FIG. 1 is a schematic of a drilling operation using the rotary steerable drilling apparatus of the current invention.

FIG. 1 depicts an underground drilling operation using a drill string 12 in which a steering apparatus 10 according to the present invention is incorporated into the lower portion of the drill string 12, commonly referred to as a bottom hole assembly 11. The drill string 12 is formed by connecting together relatively long sections of pipe 14, commonly referred to as "drill pipe." The length of the drill string 12 can be increased as the drill string progresses deeper into the earth formation 16 by connecting additional sections of drill pipe to the drill string. A drill bit 13 forms the distal end of the bottom hole assembly 11.

Torque to rotate the drill string 12 in a first rotational direction, e.g., clockwise when looking down on the drill string, may be applied by a motor 21 of a drilling rig 15 located on the surface. Drilling torque is transmitted from the motor 21 to the drill bit 13 through a turntable 22, a kelly (not shown), the drill pipe 14 and a drive shaft 24. Alternatively, the motor could be located at the very top of the drill string in what is referred to as a "top drive." The rotating drill bit 13 advances into the earth formation 16, thereby forming a bore hole 17.

A drilling fluid, commonly referred to as "mud," is pumped from the surface, through a central passage in the drill string 12, and out of the drill bit 13. The drilling mud is circulated by a pump 18 located at the surface. The drilling mud, upon exiting through the drill bit 13, returns to the surface by way of an annular passage 19 formed between the drill pipe 14 and the surface of the bore hole 17. Operation of the drilling rig 15 and the drill string 12 can be controlled in response to operator inputs by a surface control system 20.

A bottom hole assembly incorporating the steering apparatus 10 according to the current invention is shown in FIG.

2 and includes an upper bearing assembly 26, an eccentric mass assembly 28, a flexible housing 34, and upper and lower stabilizers 32 and 36 located, respectively, at opposite the ends of the flexible housing 34. The steering apparatus 10, which extends over dimension A, does not rotate during normal drilling. The section of the apparatus 10 that bends in order to effect the desired degree of steering extends over dimension B. The section of the apparatus 10 that adjusts the orientation of the bent section—in other words, its tool face—as well as controls the degree of bending, extends over dimension C. These two sections extend over dimension D.

An orientation section 71 and a bending section 91, according to the invention, are incorporated into the steering apparatus 10 between the eccentric mass assembly 28 and the flexible housing 34. Below the steering apparatus 10 is a bit box 38 and the drill bit 13. The uphole end of the steering apparatus 10 is mounted by the upper bearing assembly 26 on the drive shaft 24 so that the drive shaft, which extends through the steering apparatus, rotates within the steering apparatus. As discussed below, depending on the operating mode, the steering apparatus 10 may or may not be coupled to the drive shaft 24. The downhole end of the steering apparatus is mounted on the lower end of the drive shaft 24 through a lower bearing pack 44, shown in FIG. 9. The drive shaft 24 is driven by the drill pipe uphole of the steering apparatus and is coupled to the drill bit 13 by the bit box 38.

Figure 2:
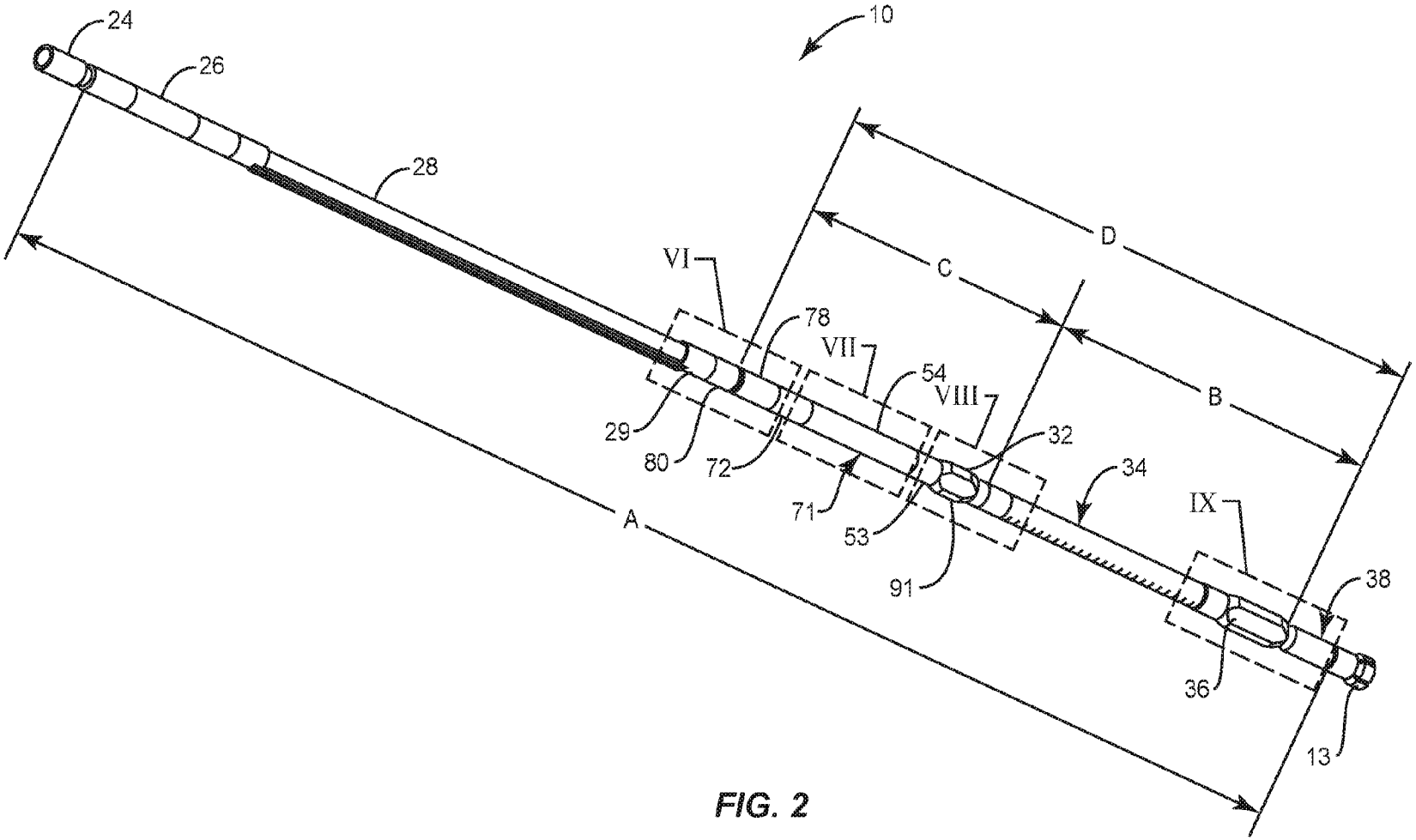
FIG. 2 is a view of one embodiment of a rotary steerable drilling apparatus of the present invention incorporated into the bottom hole assembly of the drill string shown in FIG. 1.
Figure 2A:
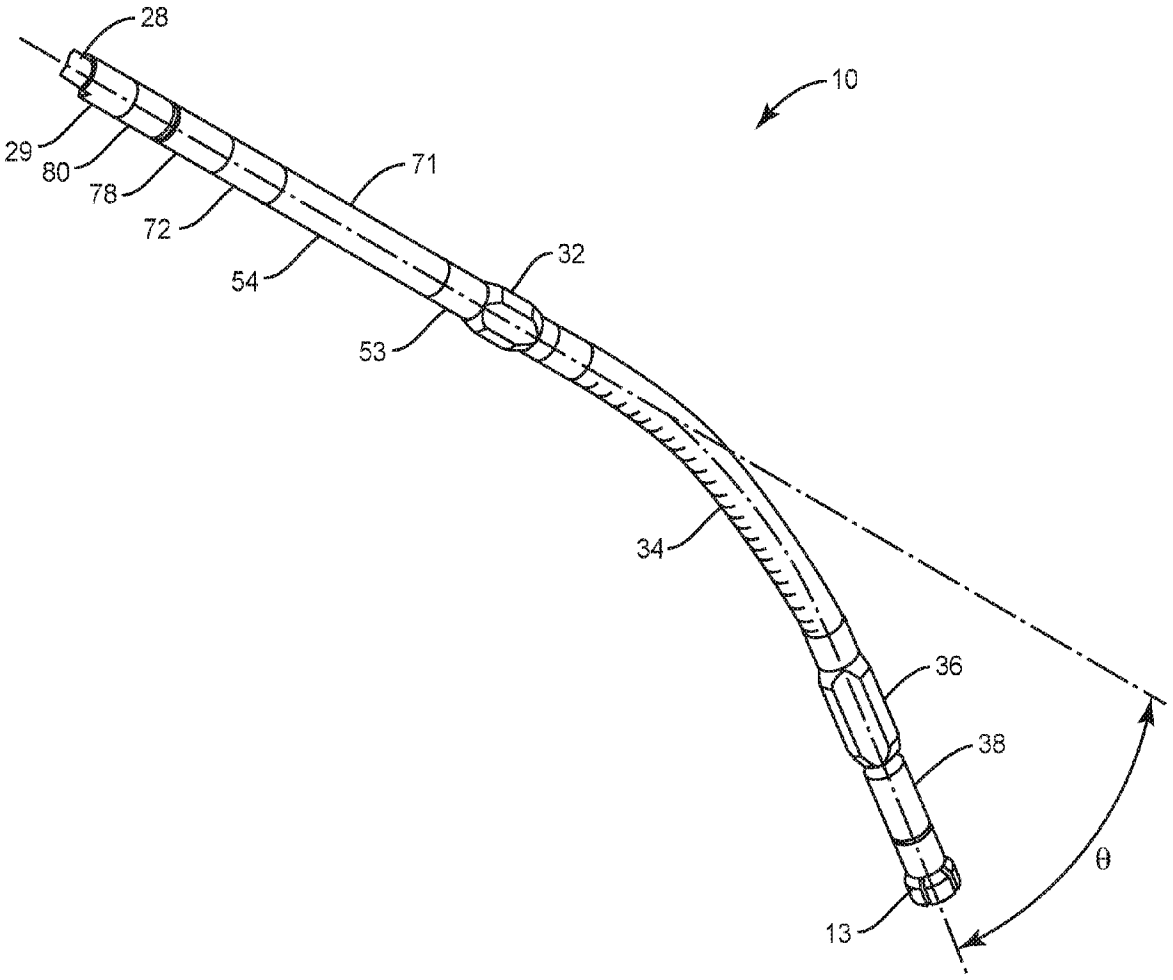
FIG. 2A is a view similar to FIG. 2 showing the effect of a bend in the flexible housing on the direction of drilling.
Figure 3:
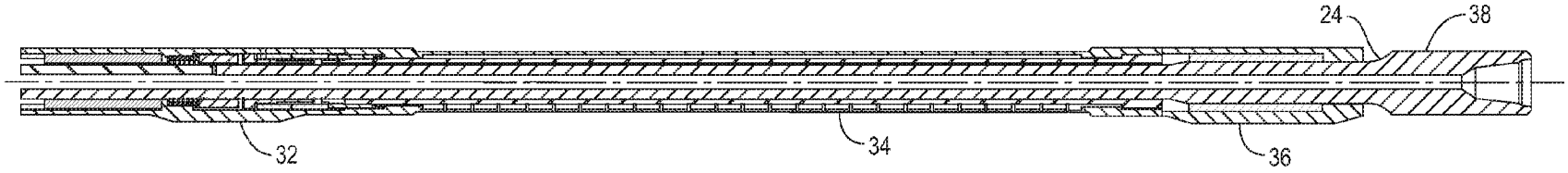
FIG. 3 is a longitudinal cross section through the lower portion of the bottom hole assembly shown in FIG. 2.

As discussed below, if after drilling in a straight ahead mode, the drill rig operator desires to alter the direction of drilling, the bending section 91 of the steering apparatus 10 can be employed to create a bend in the flexible housing 34, as shown in FIG. 2A. When the flexible housing 34 is bent, the direction in which the drill bit 13 drills is altered by an angle θ by pointing the drill bit in the desired drilling direction. Since the bending of the flexible housing is created in situ—that is, without pulling the steering apparatus 10 from the bore hole 17—the drill rig operator can switch from straight ahead drilling to directional drilling from the surface. Not only can the apparatus switch from straight ahead to directional drilling in situ, but the degree of change in the drilling direction can be adjusted in situ. For example, increasing the degree of bending in the flexible housing 34 can increase the angle θ from 1° to 5°, thereby increasing the degree of change in the drilling direction. Preferably, the change in the direction of drilling can be accomplished by rotating the drive shaft 24 from the surface.

Moreover, since the drilling direction is a three dimensional matter, the orientation section 71 of the steering apparatus 10 allows the circumferential orientation of the bend in the flexible housing 34—in other words, the tool face angle—to be controlled. After the desired drilling direction has been achieved, the steering apparatus 10 can be placed back in the straight ahead drilling mode, again without pulling the drill string from the bore hole 17.

Figure 4A:
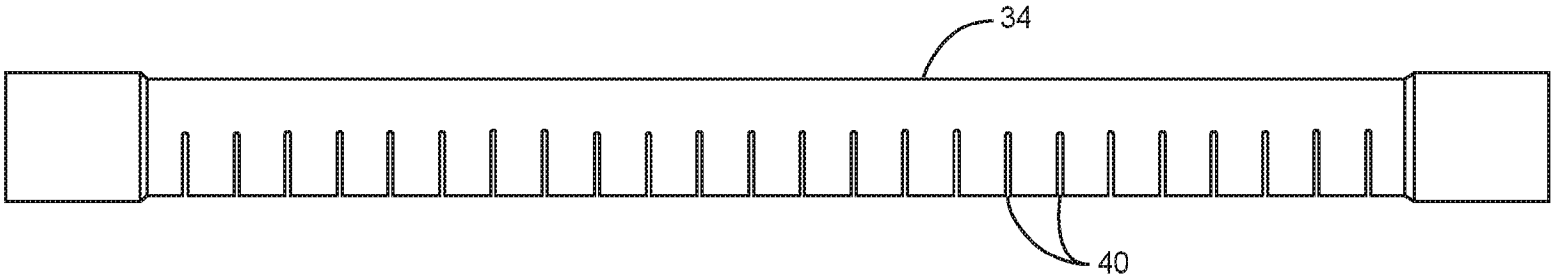
FIGS. 4A and B are views of a flexible housing portion of the rotary steerable apparatus in the relaxed (A) and compressed (B) states.
Figure 4B:
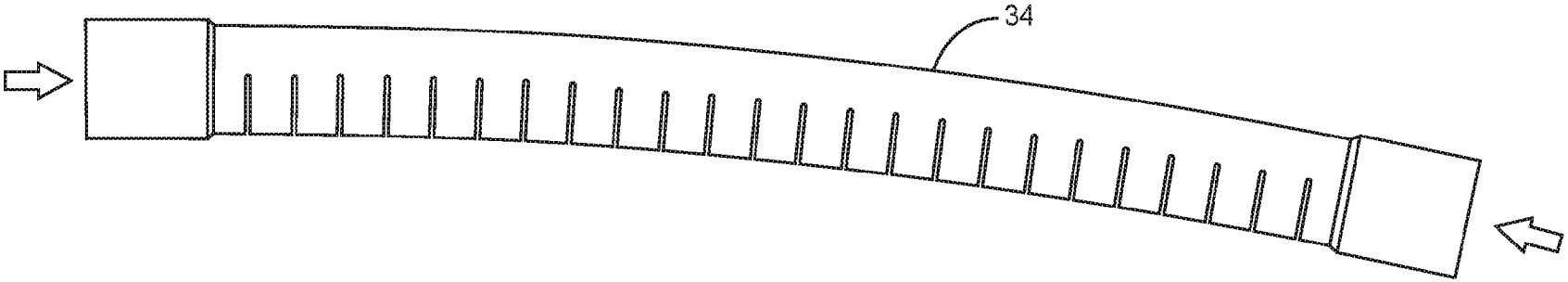

The flexible housing 34 is formed by a cylinder that may be, for example, about 1.5 m long. According to the invention, the flexible housing 34 is locally weakened around a portion of its circumference so that, when subjected to axial compression, the housing will preferentially bend in a predetermined direction, as shown in FIGS. 4A and B. For example, in the embodiment shown in FIG. 4, a series of cuts 40, axially spaced along a portion of the length of the flexible housing 34, each extend around a portion of the circumference of the housing. The cuts 40 may extend, for example, around approximately 180° of the circumference of the flexible housing 34. When compression is applied to the ends of the flexible housing 34, the housing will bend in the direction defined by the location of the cuts 40. For example, if the center of each of the cuts 40 is located at 12 o'clock position on the housing, then when compression is applied to the ends of the housing, it will deflect or bend in the 12 o'clock direction. The flexible housing 34 is preferably made from steel tubing.

Although in the preferred embodiment, the local weakening of the flexible housing 34 is created by forming cuts 40, other methods of forming local weak areas could also be utilized, such as, for example, machining one or more weakening bands around a portion of a tube's circumference such that the weakened bands don't actually break through into the inside diameter of the tube, or varying the thickness of the tube around its circumference, such as by forming the tube so that the inner and outer diameters are eccentric.

Figure 5A:
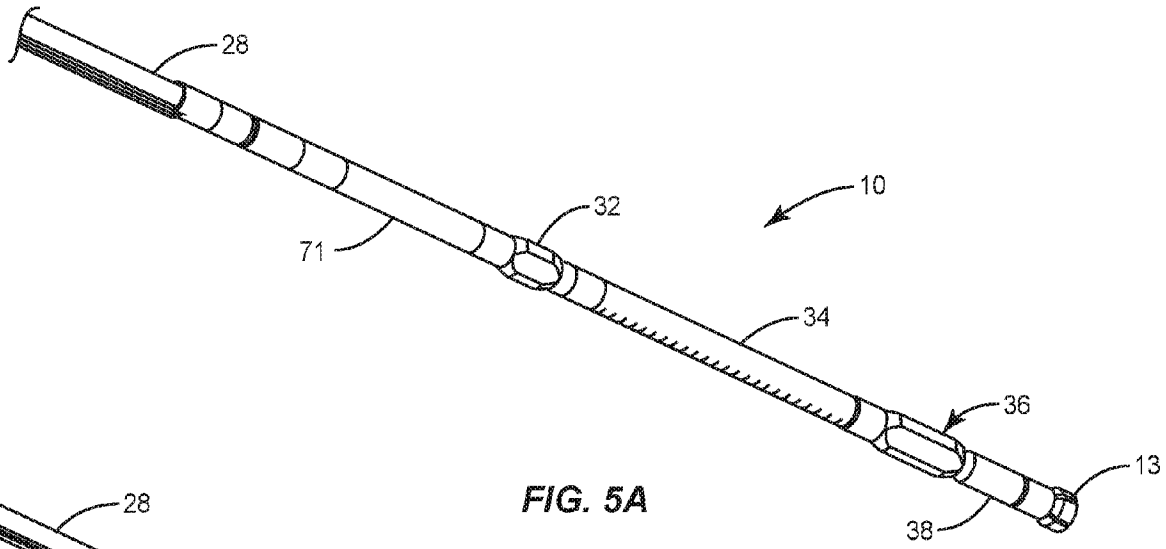
FIGS. 5A and B are views of the rotary steerable apparatus in two different circumferential orientations.
Figure 5B:
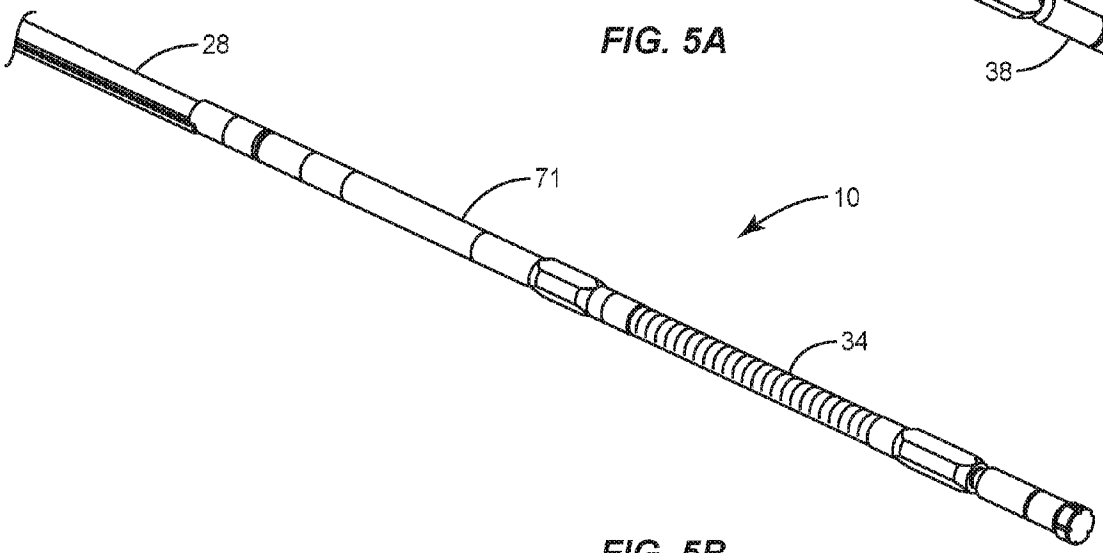

FIGS. 5A and B show the flexible housing 34 oriented in two different angular positions relative to the eccentric mass assembly 28, which as discussed below, will always be oriented in a predetermined orientation relative to the earth. In order to properly orient the flexible housing 34 to direct the drill bit 13 to drill in a given direction, information can be used concerning the angular orientation of a fixed reference point on the circumference of the drill string in relation to a reference point with respect to the earth. The reference point is typically magnetic north in a vertical well, or the high side of the bore in an inclined well. This orientation of the fixed reference point is typically referred to as "tool face," or "tool face angle." Methods for determining tool face are disclosed, for example, in U.S. Pat. No. 7,681,663 (Cobern), entitled Methods and Systems for Determining Angular Orientation of a Drill String, which is hereby incorporated by reference herein in its entirety. Since the distal end of the flexible housing 34 is mounted on the drive shaft 24 and can impose a bending force on the drive shaft, as discussed below, setting the tool face angle of the flexible housing 34 sets the direction in which the drill bit 13 will drill. Thus, for example, if the flexible housing 34 is positioned so that the weakened section 40 is oriented at a tool face angle of 120° relative to the high side of the bore hole 17, applying compression to the flexible housing will urge the drill bit 13 to drill at that tool face angle.

Figure 6:
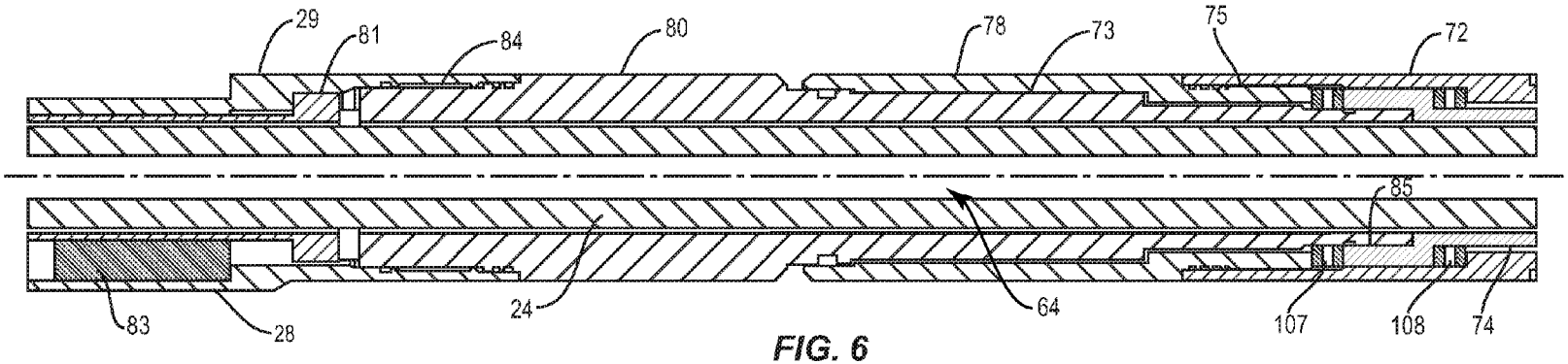
FIG. 6 is a longitudinal cross section through the portion of the apparatus enclosed by rectangle VI in FIG. 2.
Figure 7:
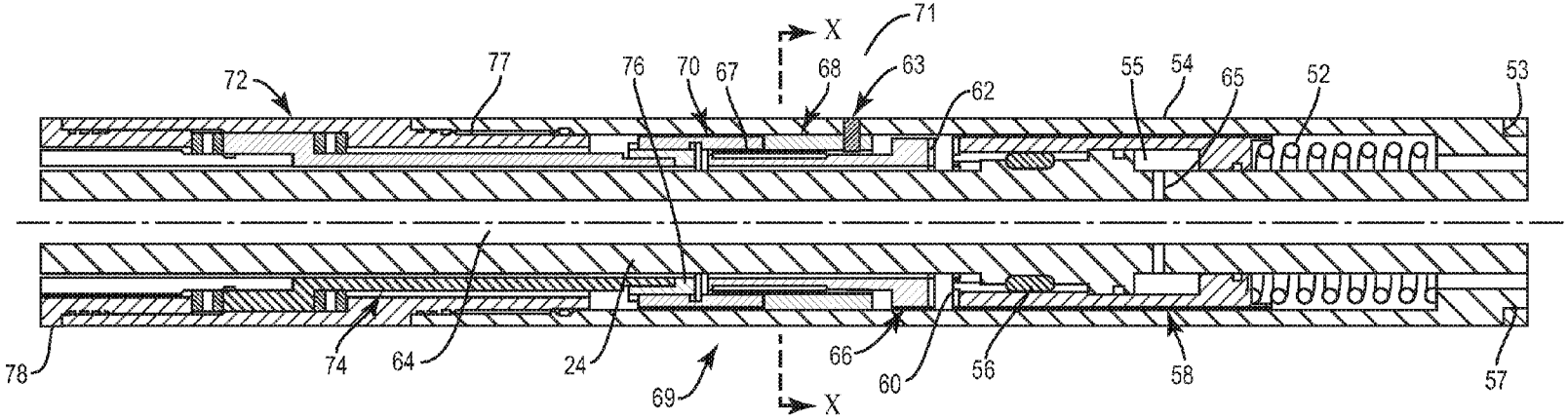
FIG. 7 is a longitudinal cross section through the portion of the apparatus enclosed by rectangle VII in FIG. 2.
Figure 10:
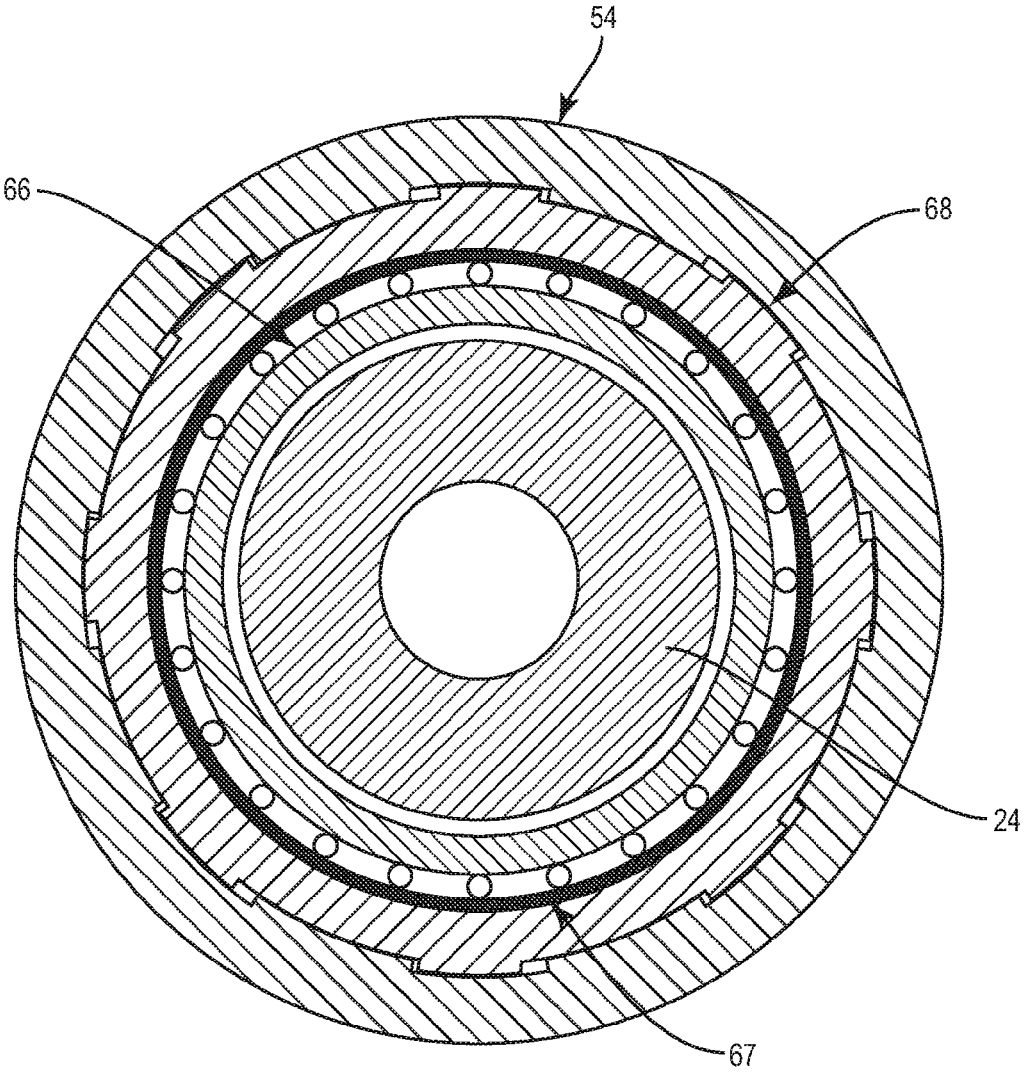
FIG. 10 is a transverse cross section taken through line X-X shown in FIG. 7.

The mechanism used for adjusting the tool face angle of the weakened portion of the flexible housing 34, which alters the direction of drilling, is shown in FIGS. 6, 7 and 10. The eccentric mass assembly 28, the downhole end of which is shown on the left in FIG. 6, is comprised of a housing 29, an inner tube 81 and a weighted mass 83. The inner tube 81 serves to hold the weighted mass 83 in place and prevents it from contacting the drive shaft which is rotating through the center of the eccentric mass assembly. The weighted mass 83, which is rotationally fixed with respect to the housing 29, extends around only a portion of the circumference of the assembly 28. The eccentric mass assembly 28 is mounted by means of the upper bearing assembly 26 so as to be free to rotate with respect to the drive shaft 24. As explained below, a portion of the drill string downhole, and in particular the flexible housing 34, can be rotated relative to the eccentric mass assembly 28. Since the drive shaft 24 rotates within the bottom hole assembly 11, when the drive shaft 24 is driving rotation of the drill bit 13, the eccentric mass assembly 28 is not rotating and, in particular, it remains circumferentially oriented so that, under the influence of gravity, the weighted mass 83 is always aligned with the low side of the bore hole 17—that is, the tool face angle of the eccentric mass assembly 28 remains constant. As a result, the eccentric mass assembly 28 can be used as a reference for adjusting the tool face angle of the flexible housing 34.

An orientation section 71 for adjusting the tool face angle of the flexible housing 34 is located between the eccentric mass 28 and the flexible housing 34, and incorporates a reduction gear, which in the preferred embodiment is a harmonic drive 69. In particular, the downhole end of the eccentric mass housing 29 is coupled by a threaded joint 84 to a sleeve 80 so that the eccentric mass housing 29 and the sleeve 80 rotate together. A housing 78 is coupled by a threaded joint 75 to a housing 72 so that the housing 78 rotates with housing 72.

The sleeve 80 is coupled to an extension 74 by a threaded joint 85 so that sleeve 80 rotates with the extension 74. Extension 74, which is supported by thrust bearings 107 and 108, is coupled to a circular spline 70 of the harmonic drive 69 via coupling 76 so that extension 74 rotates with the circular spline 70. The sleeve 80, eccentric mass housing 29, and the circular spline 70 rotate as a single unit. A rotating joint 73 is formed between the sleeve 80 and the housing 78 that permits the housing 78 to rotate relative to the sleeve 80. As discussed below, this allows the circumferential orientation of the flexible housing 34 (in other words, the tool face angle of the bend) to be varied with respect to the eccentric mass 83.

The harmonic drive 69 is comprised of the circular spline 70, a housing drive 68, a wave generator 66 and a flex spline 67. As is typical of harmonic drives, the gear ratio of the harmonic drive 69 is high, for example 1:160. A housing 54 is joined to housing 72 via a threaded connection 77 so that housing 72 rotates with housing 54. Pins 63 lock the housing drive 68 to the housing 54. Alternatively, splines, such as those shown in FIG. 10, could be used to lock the housing drive to the housing 54. A piston 58 is mounted onto the drive shaft 24 and coupled to it via splines 56 so that the piston rotates with and slides on the drive shaft. A spring 52 biases the piston 58 in the uphole direction (to the left in FIG. 7) toward the wave generator 66 and flex spine 67. Preferably a thrust bearing is disposed between the spring 52 and the portion of the housing 54 against which it seats.

During normal drilling, the surface mud pump 18 is operated to drive drilling fluid through a central passage 64 in the drive shaft 24 to the drill bit 13. A radial passage 65 connects the central passage 64 to a piston chamber 55. When the mud pump 18 is operating during normal drilling, the drilling mud pressurizes the chamber 55 and drives the piston 58 in the downhole direction (to the right in FIG. 7). The spring constant of the spring 52 and size of the piston 58 are selected such that the force generated by the pressure of the drilling mud during normal drilling is sufficient to overcome the opposing force of the spring 52 so that the uphole face of the piston 58 is displaced from the downhole face of the wave generator 66. As a result, during normal drilling, the drive shaft 24 is uncoupled from the harmonic drive 69 and downhole portion of the drill string in which the flexible housing 34 is mounted.

However, when the flow of drilling mud is stopped, or reduced to a sufficiently low flow rate, the spring 52 drives the piston 58 in the uphole direction (to the left in FIG. 7), causing splines 60 on the face of the piston to engage mating splines 62 on the face of the wave generator 66 so that the piston drives the wave generator, which is the input for the harmonic drive 69. The circular spline 70 is rigidly coupled to the eccentric mass 28, which applies a reactive torque to the harmonic drive 69. Housing 54 is coupled via threaded joint 57 to a housing 53 of the uphole stabilizer 32. As a result, the drive housing 68, which is effectively the output of the harmonic drive 69, drives the rotation of the housing 54, via pins 63, and thence housing 53 of the uphole stabilizer 32.

Figure 8:
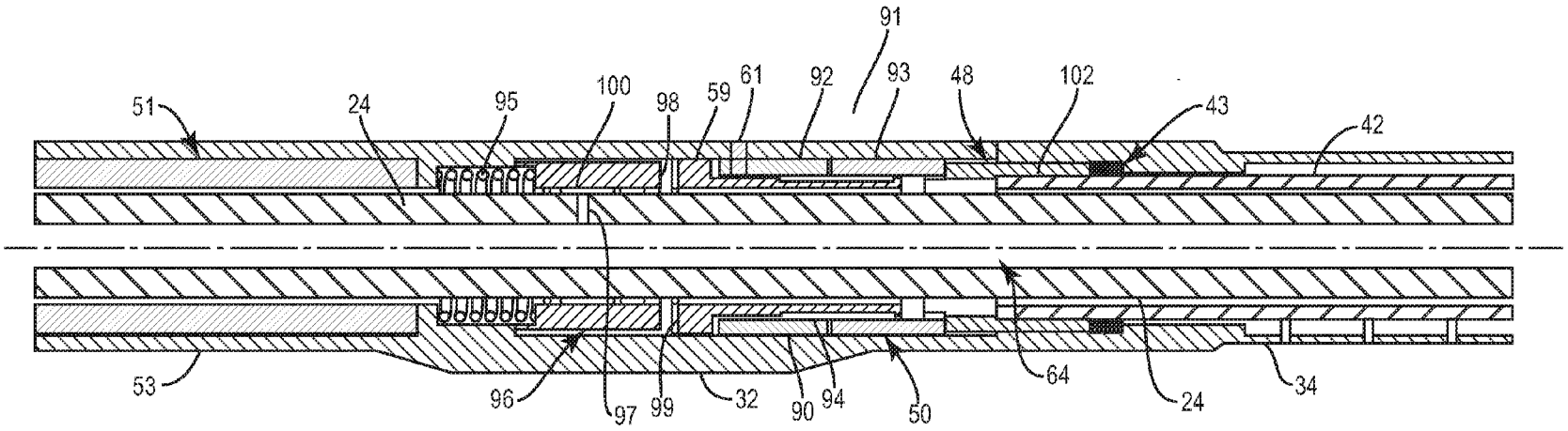
FIG. 8 is a longitudinal cross section through the portion of the apparatus enclosed by rectangle VIII in FIG. 2.
Figure 9:
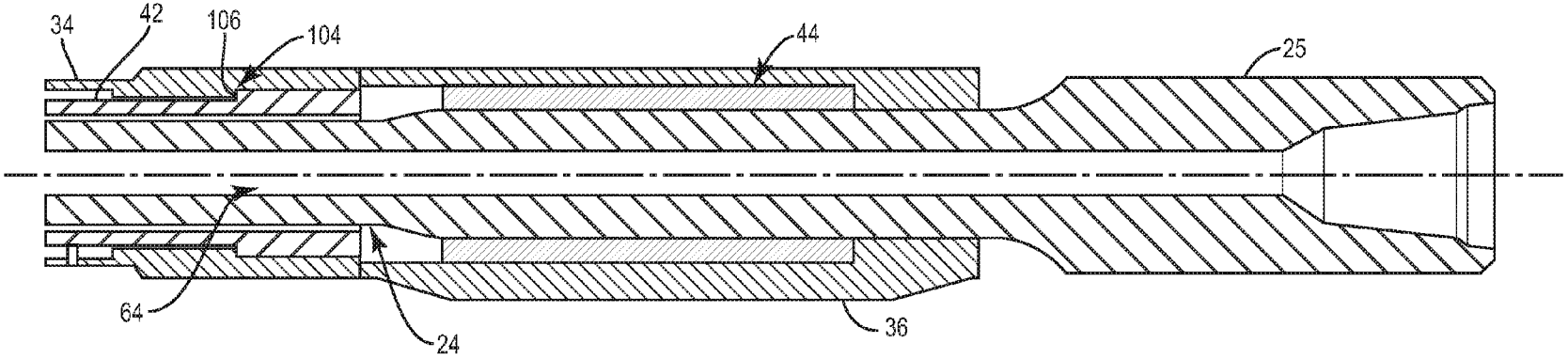
FIG. 9 is a longitudinal cross section through the portion of the apparatus enclosed by rectangle IX in FIG. 2.

As shown in FIG. 8, the uphole end of the upper stabilizer housing 53 is supported on the drive shaft 24 by an upper bearing pack 51. The downhole end of the stabilizer housing 53 is coupled to the uphole end of the flexible housing 34 so that the flexible housing rotates with the stabilizer housing. As shown in FIG. 9, the downhole end of the flexible housing 34 is coupled to the housing of the lower stabilizer 36, which is supported on the drive shaft 24 by a lower bearing pack 44. Consequently, when the flow of drilling mud is stopped, the drive shaft 24 drives the rotation of the harmonic drive 69, via the piston 58, so that the flexible housing 34 slowly rotates, due to the high gear reduction of the harmonic drive 69, with respect to the eccentric mass assembly 28, thereby altering the tool face angle of the bend in the flexible housing. The longer the harmonic drive 69 is engaged and the drive shaft 24 rotated, the greater the change in the tool face angle of the flexible housing 34.

Since the gear ratio of the harmonic drive 69 used to effect adjustment of the flexible housing tool face angle is known, if the initial tool face angle of the flexible housing 34 is known, then by keeping accurate track of the number of rotations of the drive shaft 24 when the harmonic drive is engaged, one can determine the change in tool face angle of the flexible housing necessary to drill in a given direction. For example, suppose the initial tool face angle of the flexible housing was set a 0° when the flexible housing was incorporated into the drill string—in other words, the bend in the flexible housing was aligned with the eccentric mass. If the gear ratio of the harmonic drive 69 is 160:1, then eighty revolution of the drive shaft 24 will result in a 180° change in the flexible housing tool face angle to a tool face angle of 180°.

As previously discussed, as a result of the effect of gravity on the weighted mass 83, the eccentric mass 28 will remain at a given orientation with respect to the bore hole 17. For example, the weighted mass 83 may be referenced as oriented at a tool face angle of 180°. If the center of the cuts 40 in the flexible housing 34 is circumferentially aligned with the weighted mass 83, the application of compression to the flexible housing 34 will steer the drill bit 13 in that direction—that is, at a tool face angle of 180°. If, however, the mud pump 18 is shut down and the drive shaft 24 rotated sufficiently to rotate the flexible housing 34 by 180°, as explained above, then compression of the flexible housing 34 will steer the drill bit at a tool face angle of 0°—in other words, the direction of drilling is altered. Thus, by controlling the rotation of the flexible housing 34, the orientation—or tool face angle—of the bend in the bottom hole assembly 11 can be adjusted to alter the direction of steering.

As shown in FIG. 8, according to one embodiment, a bending section 91 for adjusting the amount of bend in the flexible housing 34 is incorporated uphole of the flexible housing. However, it should be understood that the orientation section 71 discussed above could be used without employing a bending section 91. The bending section 91 is, in many respects, similar in arrangement to the orientation section 71 and includes a second harmonic drive 90. The drive shaft 24 is coupled via the second harmonic drive 90 and a nut 48 to a tension tube 42. The harmonic drive 90 is comprised of a circular spline 92, a circular drive 93, a wave generator 59 and a flex spline 94. Like the orientation section harmonic drive 69, the gear ratio of the bending section harmonic drive 90 is preferably high, for example at least 1:60. The stabilizer housing 53 is locked to the circular spline 92 via pins 61. A piston 96 is mounted onto the drive shaft 24 and coupled to it via splines so that the piston rotates with and slides on the drive shaft. A spring 95 biases the piston 96 in the downhole direction (to the right in FIG. 8) toward the wave generator 59 and flex spine 94. Preferably a thrust bearing is disposed between the spring 95 and the portion of the stabilizer housing 53 against which it seats.

As previously discussed, during drilling, the surface mud pump 18 is operated to pump drilling fluid through a central passage 64 in the drive shaft 24 to the drill bit 13. A radial passage 97 connects the central passage 64 to a piston chamber 100. Thus, when the mud pump 18 is operating during normal drilling, the drilling mud pressurizes the chamber 100 and drives the piston 96 in the uphole direction (to the left in FIG. 8). The spring constant of the spring 95 and the size of the piston 96 are selected such that the force generated by the pressure of the drilling mud is sufficient to overcome the opposing force of the spring 95 so that the downhole face of the piston 96 is displaced from the downhole face of the wave generator 59. As a result, during normal drilling, the drive shaft 24 is uncoupled from the harmonic drive 90 and the tension tube 42.

However, when the flow of drilling mud is stopped, or sufficiently reduced, the spring 95 drives the piston 96 in the downhole direction, causing splines 98 on the face of the piston to engage mating splines 99 on the face of the wave generator 59. In this case, the circular drive 93 is effectively an output of the harmonic drive 90 and drives rotation of the nut 48, which is threaded onto mating threads on the uphole end of the tension tube 42. As a result, the drive shaft 24 is coupled via the harmonic drive 90 to the tension tube 42. In particular, rotation of the drive shaft 24 and piston 96 causes slow rotation of the circular drive 93 and the nut 48 to which it is coupled. As a result of mating threads 102 on the inside diameter of the nut 48 and the outside diameter of the tension tube 42, and a spherical thrust washer 43, rotation of the nut causes axial displacement of the tension tube 42. For example, rotation of the nut 48 in the clockwise direction (looking downhole) will displace the tension tube 42 in the uphole direction, whereas counterclockwise rotation will displace the tension tube in the downhole direction.

As shown in FIG. 8, the uphole end of the flexible housing 34 is coupled to the downhole end of the housings 53 of the stabilizer 32, thereby preventing displacement of the flexible housing in the uphole direction. As shown in FIG. 9, a shoulder 104 formed on the downhole end of the tension tube 42 abuts a shoulder 106 formed on the flexible housing 34. Since the flexible housing 34 is restrained from displacement in the uphole direction by the stabilizer 32, displacement of the tension tube 42 in the uphole direction as a result of clockwise rotation of the nut 48 places the tension tube in tension and causes the shoulder 104 of the tension tube 42 to impart a compressive force on the flexible housing 34. As previously discussed, the application of compression to the flexible housing 34 causes it to preferentially bend in the direction of its local weakening. Thus, the tension tube 42 functions as a tension member to apply compressive force to the flexible housing 34, which functions as a bending member. The greater the compressive force, the greater the bending of the flexible housing 34. The bending of the flexible housing 34 imparts bending forces onto the tension tube 42 and drive shaft 24 so as to impart a bend to the bottom hole assembly that alters the amount of bending in the previously set direction in which the drill bit drills.

Thus, by controlling the magnitude of the compressive force applied to the flexible housing 34 by the tension tube 42, the amount of the bending, sometimes referred to as the dogleg severity, and therefore the degree of steering (i.e., the magnitude of the change in the direction of drilling) can be adjusted. For example, a first amount of rotation of the nut 48, which will result in a first amount of displacement of the tension tube 42, may result in a change θ in the direction of drilling of 1°, whereas a greater rotation of the nut, which results in a greater displacement of the tension tube, will result in a 5° change in the direction of drilling.

Although in the preferred embodiment described above, harmonic drives 69 and 90 are employed to couple the drive shaft 24 to the mechanism for rotating the flexible housing 34 to effect a change in the tool face angle and to the mechanism for bending the flexible housing to effect a change in the degree of the change in the drilling direction, other forms of reduction gears could also be utilized, such as, for example, a planetary gear train or other epicyclic gear train. Alternatively, in some applications, no reduction gear need be used so rotation and/or bending of the flexible housing 34 was achieved via direction rotation by the drive shaft.

Figure 11A:
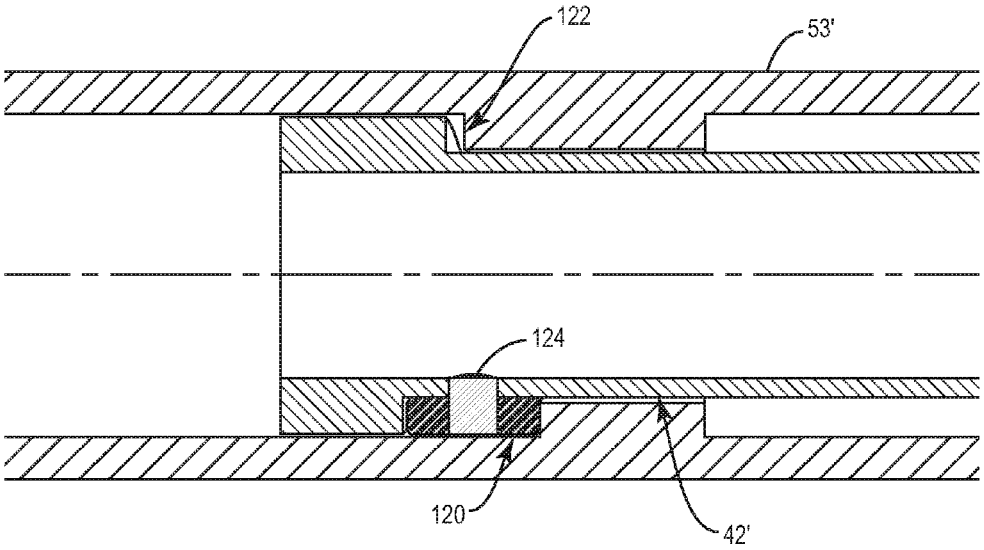
FIGS. 11A and B are longitudinal cross sections showing an alternate embodiment of the mechanism for rotating the tension tube, with the tension tube shown in two different circumferential orientations.
Figure 11B:
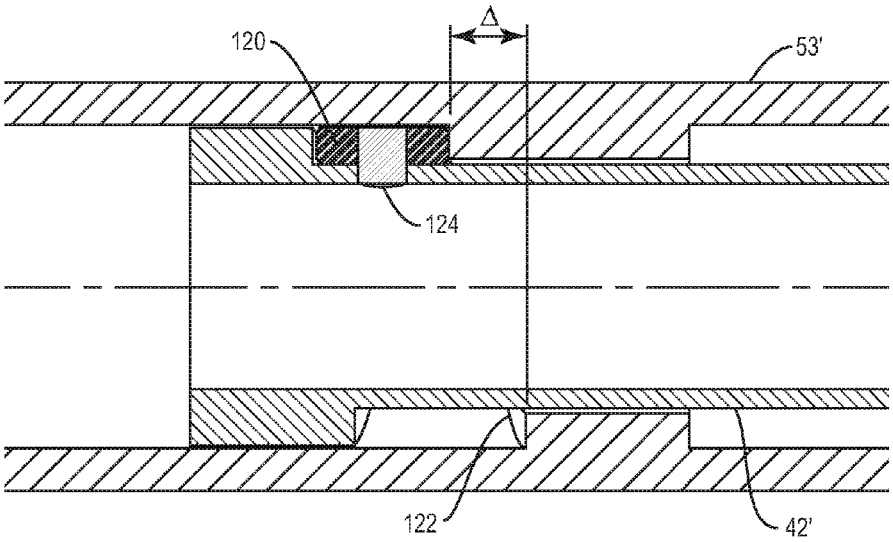

In the embodiments discussed above, displacement of the tension tube 42 is effected by rotating a nut onto a threaded portion of the tension tube so that the tension tube effectively acts as a lead screw. FIGS. 11A and B show an alternate embodiment of a mechanism for displacing the tension tube 42 utilizing a cam mechanism. In this embodiment, the tension tube 42' moves both axially and rotationally with respect to the housing 53' of the uphole stabilizer 32. In this embodiment, the tension tube 42' is rigidly coupled to the circular drive 93 so that rotation the circular drive 93 of the harmonic drive 90 drives rotation of the tension tube. A circular cam surface 122 is formed on an uphole facing internal surface of the housing 53' so that the axial position of the cam surface 122 varies around its circumference. A cam follower 120 is rotatably mounted via pin 124 on the tension tube 42'. Thus, rotation of the tension tube 42' causes the cam follower 120 to follow the cam surface 122, thereby axially displacing the tension tube. As shown in FIG. 11B, 180° of rotation of the tension tube 42' causes a maximum displacement Δ of the uphole end of the tension tube. The displacement of the tension tube 42' imposes compression on the flexible housing 34, as before.

In the embodiments discussed above, rotation of the drive shaft 24 while drilling mud is not being pumped through the drill string is used to effect rotation of both the upper harmonic drive 69 in the orientation section 71(shown in FIG. 7), which adjusts the tool face angle of the flexible housing 34, and the lower harmonic drive 90 in the bending section 91(shown in FIG. 8), which adjusts the amount of bending of the flexible housing 34. As a result, if adjustment of both the tool face angle and the amount of bending of the flexible housing 34 is incorporated into the bottom hole assembly, the two adjustments will occur simultaneously.

Figure 12A:
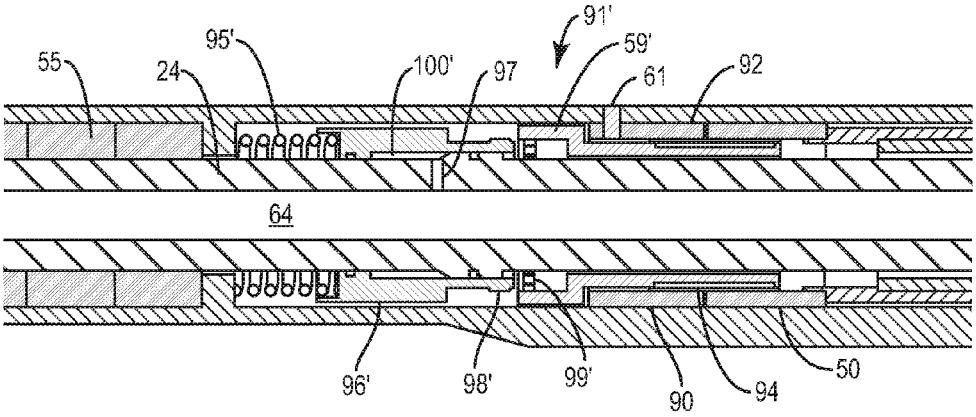
FIGS. 12A, B and C are longitudinal cross sections showing an alternate embodiment of the section for adjusting the bending in the bottom hole assembly, with the drive piston shown in three different axial positions.

FIGS. 12A, B and C depict an alternate embodiment of the bending section 91 that allows adjustment of the amount of bending independently from the adjustment of the tool face of the flexible housing 34. In this embodiment, the splines 98' on the piston 96' extend radially and are configured so as to engage the mating splines 99' on the wave generator 59' only when the drilling mud in the central passage 64 is at an intermediate pressure between the full pressure employed during drilling, when the flow rate of drilling mud from the pump 18 is high, and the low pressure that exists when the mud pump 18 is shut off. Preferably, the portion of the bottom hole assembly in which the piston resides is pressure compensated so that, when the mud pump 18 is off, both central passage 64 and the bore hole annulus are under the same hydrostatic head and, therefore, there is no differential pressure. However, when the mud pump 18 is running, there is a differential pressure, because the drill bit nozzles create a restriction in the flow, creating back pressure that causes the pressure in the central passage 64 to be higher than pressure in the bore hole annulus. It is this differential pressure that is used to operate the pistons.

Figure 12B:
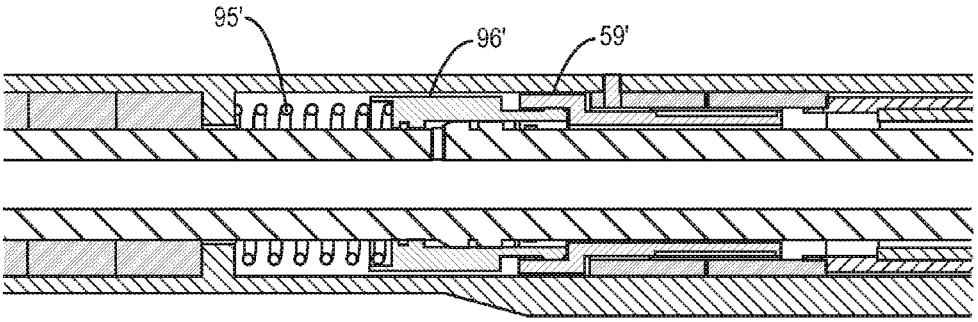

In particular, the spring constant of the spring 95' and the effective area of the piston 96' upon which the drilling mud in the chamber 100' acts is adjusted so that the differential pressure across the piston when the mud pump 18 is operating during normal drilling, which may be in the range of 400 psi to 600 psi, is sufficient so that the force on the piston 96' overcomes that of the spring 95' and drives the piston out of engagement with the wave generator 59', as shown in FIG. 12A. As shown in FIG. 12B, when the mud pump 18 is shut off and the pressure of drilling mud in both the central passage 64 and the bore hole 17 is that of the hydrostatic head, the spring 95' exerts sufficient force on the piston 96' to drive it sufficiently far so that the splines 98' on the piston slide past the splines 99' on the wave generator 59' so that the piston cannot drive rotation of the wave generator.

Figure 12C:
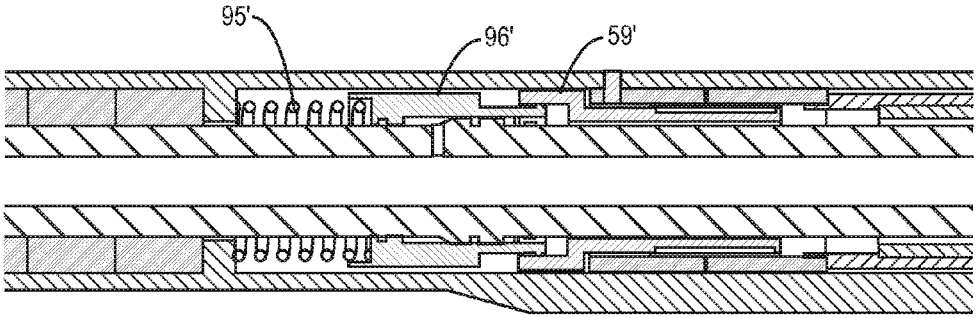

As shown in FIG. 12C, the spring 95' and piston 96' are designed so that at intermediate pressures, for example, a differential pressures across the piston in the range of 200 psi to 300 psi, forces from the spring and piston balance sufficiently to displace the piston axially by a distance that causes the external splines 98' on the piston to engage the internal splines 99' on the wave generator 59'. As a result, rotation of the drive shaft 24, via the piston 96', drives rotation of the wave generator and, therefore, the nut 48 or cam follower 120 that adjusts axial tension of the tension tube 42 so as to adjust the compressive force on, and therefore the amount of bending of, the flexible housing 34. The differential pressure across the piston can be regulated by adjusting the flow rate of the mud pump.

Although the foregoing method of separately adjusting the tool face angle of the flexible housing 34 from the amount of bending has been discussed by employing intermediate pressure drilling mud to operate the bending section 91, this arrangement could be incorporated into the orientation section 71, instead of, or in addition to, the bending section. In this arrangement, the piston 58 of the orientation section 71 would, under the influence of the spring 52, assume fully retracted and fully extended axial positions, so that it was disengaged, when the pressure of the drilling mud was very high or very low. Similarly, at an intermediate pressure, the piston would be driven into engagement with the harmonic drive 69.

Thus, according to the invention, the rotary steering apparatus includes one section for adjusting the tool face angle of the bend in the bottom hole assembly so as to alter the direction in which the drill bit drills, and another section for adjusting the amount of the bend so as to alter the degree of directional change in the direction in which the drill bit drills. These adjustments can be performed in situ—that is, the tool face angle and the degree of bending in the bottom hole assembly can be altered while the bottom hole assembly 11 is still inserted into the bore hole 17 so that it is not necessary to remove the bottom hole assembly from the bore hole to effect these adjustments. Moreover, the adjustments can be accomplished with only a momentary stoppage of the drilling.

Figure 13:
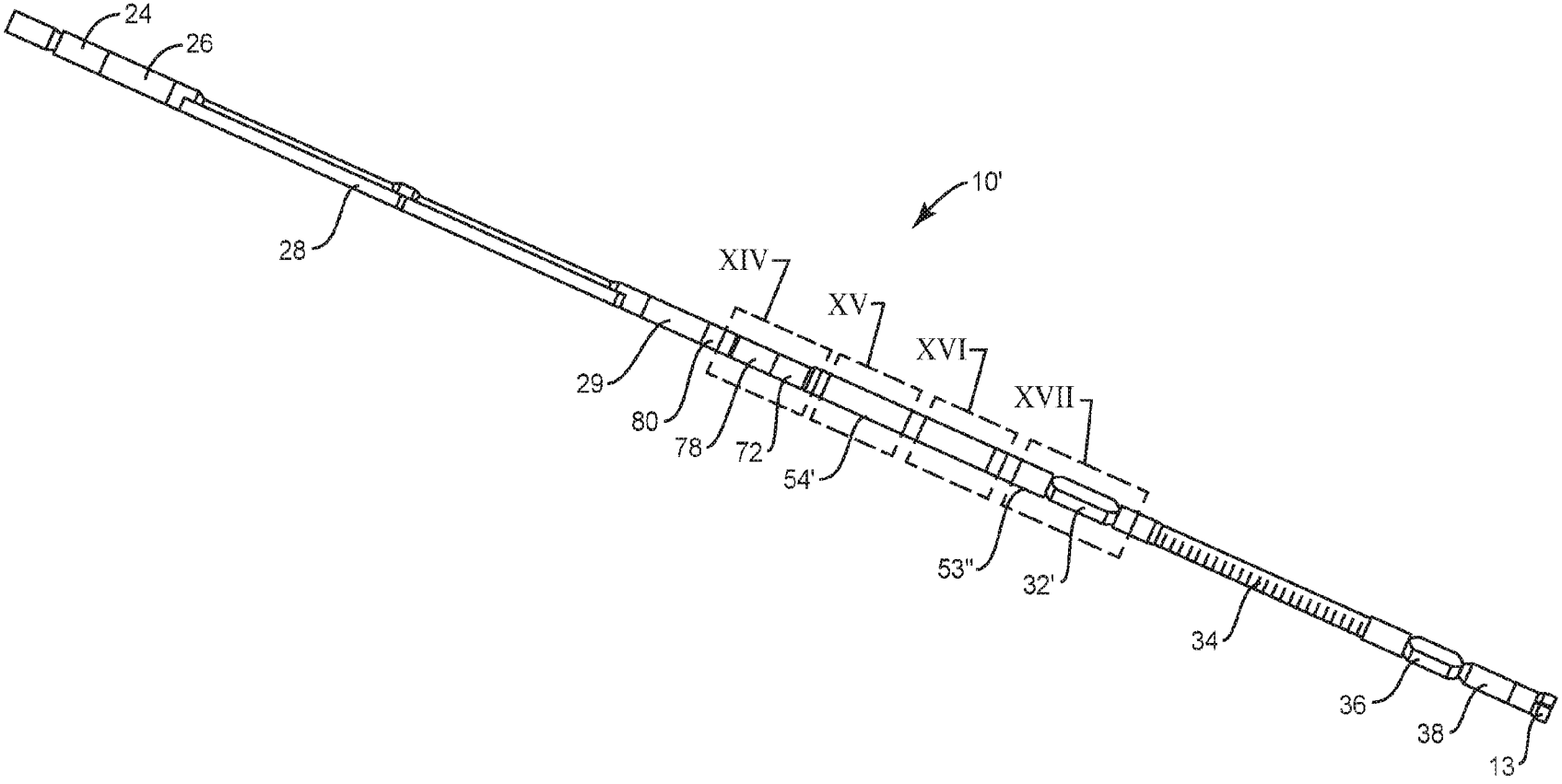
FIG. 13 is a view of an alternate embodiment of a rotary steerable drilling apparatus of the present invention.
Figure 14:
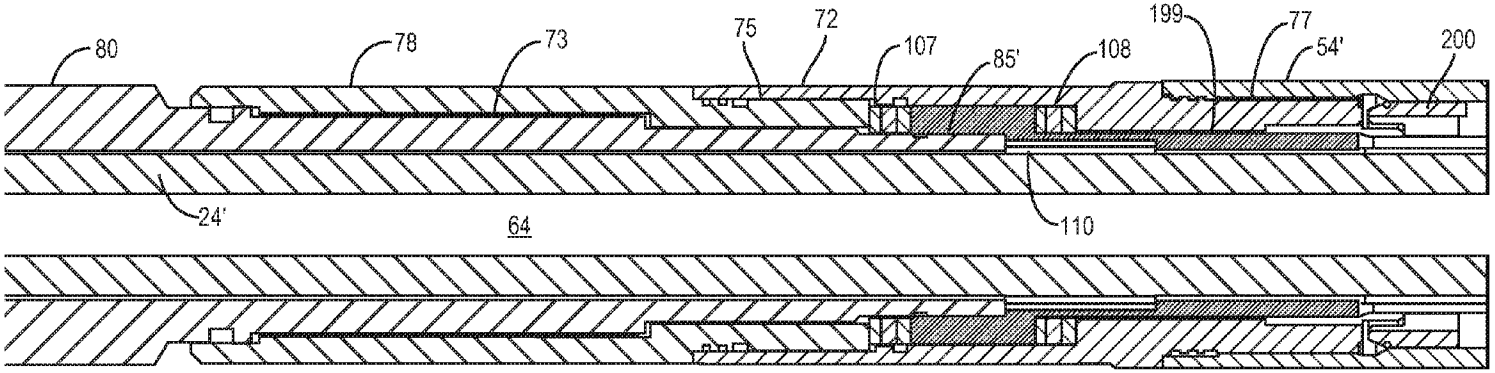
FIG. 14 is a longitudinal cross section through the portion of the apparatus enclosed by rectangle XIV in FIG. 13.
Figure 17:
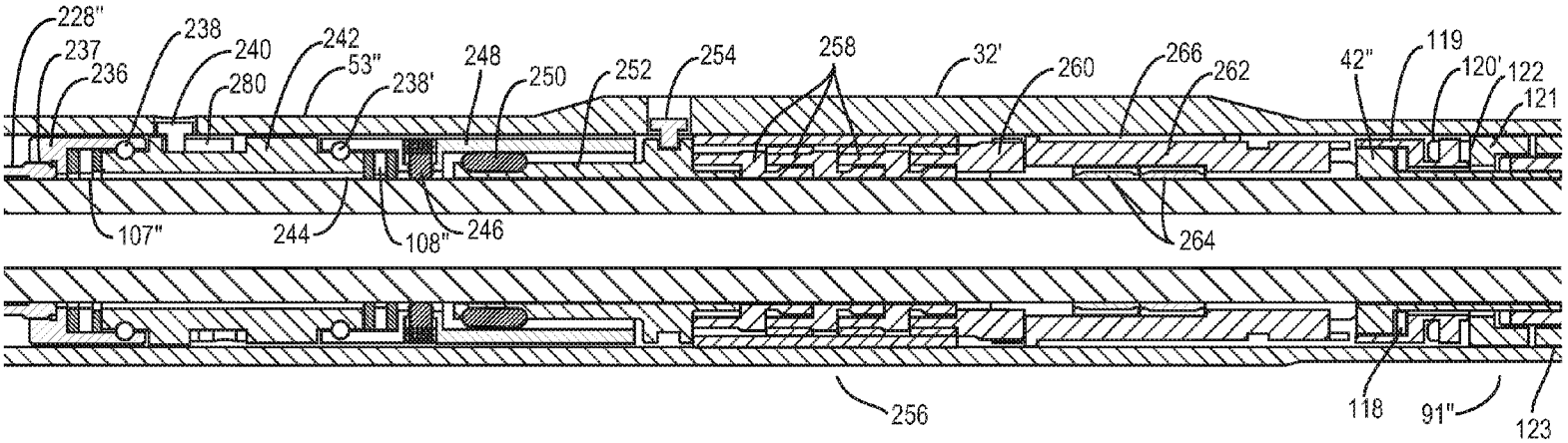
FIG. 17 is a longitudinal cross section through the portion of the apparatus enclosed by rectangle XVII in FIG. 13.
Figure 18:
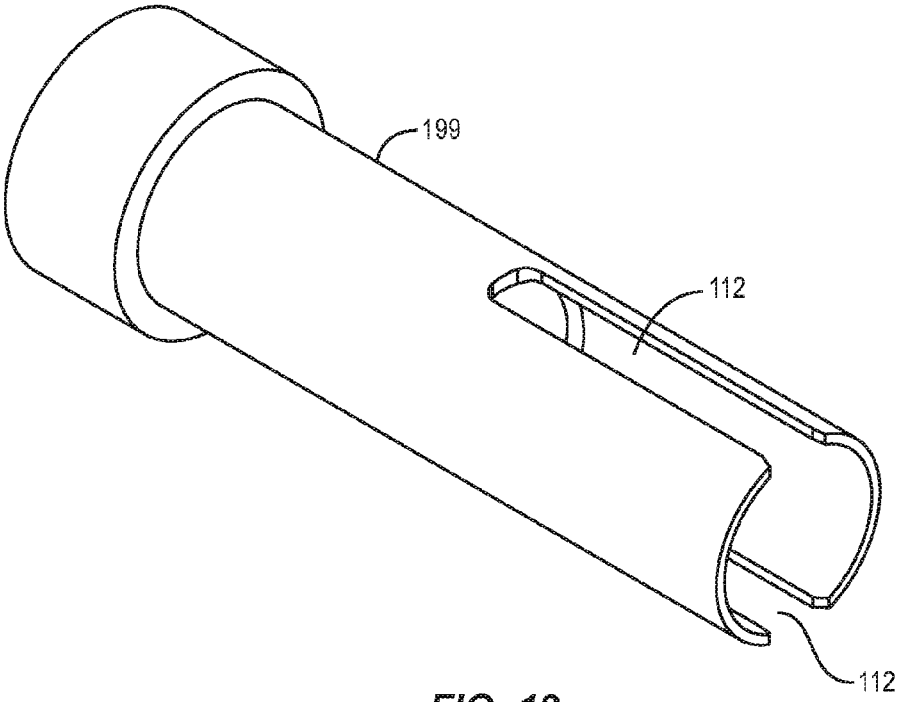
FIG. 18 is an isometric view of the stop ring shown in FIGS. 14 and 15.
Figure 19:
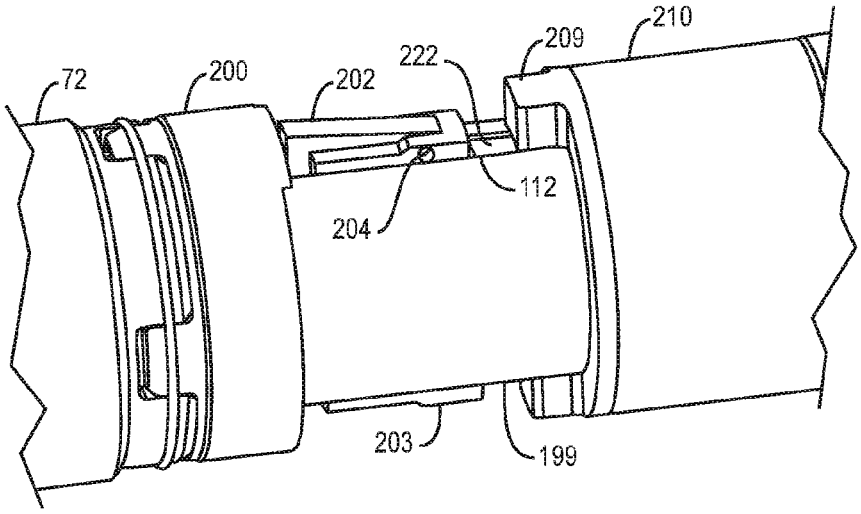
FIG. 19 is an isometric view of a section of the apparatus shown in FIG. 15, including the orientation ring, stop ring, latch key, orientation sleeve, harmonic drive cap and circular spline.
Figure 20:
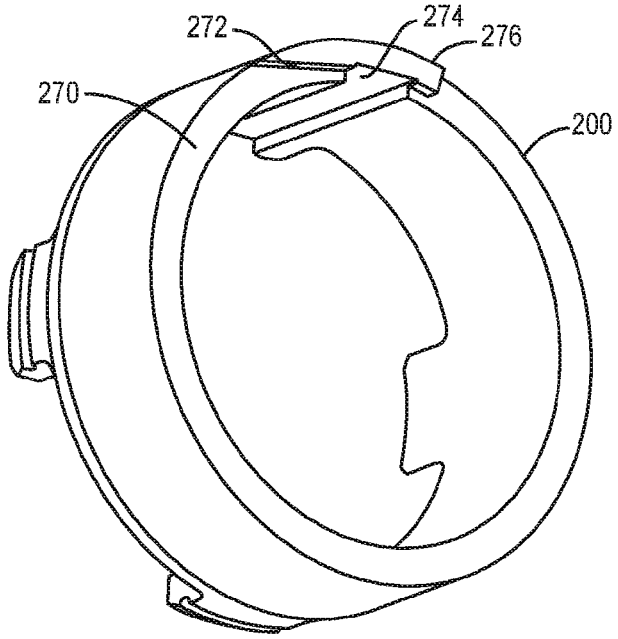
FIG. 20 is an isometric view of the orientation ring shown in FIG. 19.

Another embodiment of the steering apparatus 10' of the invention is shown in FIGS. 13-23. As in the prior embodiment, the downhole end of the eccentric mass housing 29 is coupled by a threaded joint 84 to a sleeve 80 so that the eccentric mass housing 29 and the sleeve 80 rotate together, as shown in FIG. 13. Housing 78 is supported on sleeve 80 by a rotating joint 73 so that housing 78 rotates with respect to the sleeve 80. Housing 78 is also coupled by a threaded joint 75 to housing 72 so that housing 78 rotates with housing 72. Housing 54' is coupled by threaded joint 77 to housing 72 so that housing 54' rotates with housing 72. As shown in FIGS. 14 and 19, the housing 72 engages an orientation ring 200, which is shown in FIG. 20. The housing 54' is coupled to the flexible housing 34 via the stabilizer housing 53" so that the flexible housing 34 rotates with the housing 54'. Thus, the orientation ring 200, housings 54, 72, 78 and 53" and the flexible housing 34 are all rotationally fixed with respect to each other so that they rotate as an assembly relative to the sleeve 80 and eccentric mass assembly 28 via the rotating joint 73. Alternatively, all or some of these components could be integrally formed.

As also shown in FIG. 14, sleeve 80 is coupled to a stop ring 199 by a threaded joint 85' so that the stop ring 199 rotates with sleeve 80 and, therefore, the eccentric mass assembly 28. Stop ring 199 is supported axially by thrust bearings 107 and 108 and supported radially by roller bearing 110 on upper drive shaft section 24', which is threaded onto lower drive shaft section 24". As shown in FIG. 18, the stop ring 199 has two opposing slots 112 extending from its downhole end. Since the stop ring 199 is rotationally fixed to the eccentric mass assembly 28, and the circumferential orientation of the eccentric mass assembly is always known (i.e., the low side of the bore hole 17), the orientation of the slots 112 in stop ring 199 is always known and serves to establish a tool face "reference" orientation for the bend in the flexible housing 34, as discussed below in connection with the operating mode shown in FIG. 23C.

Figure 15:
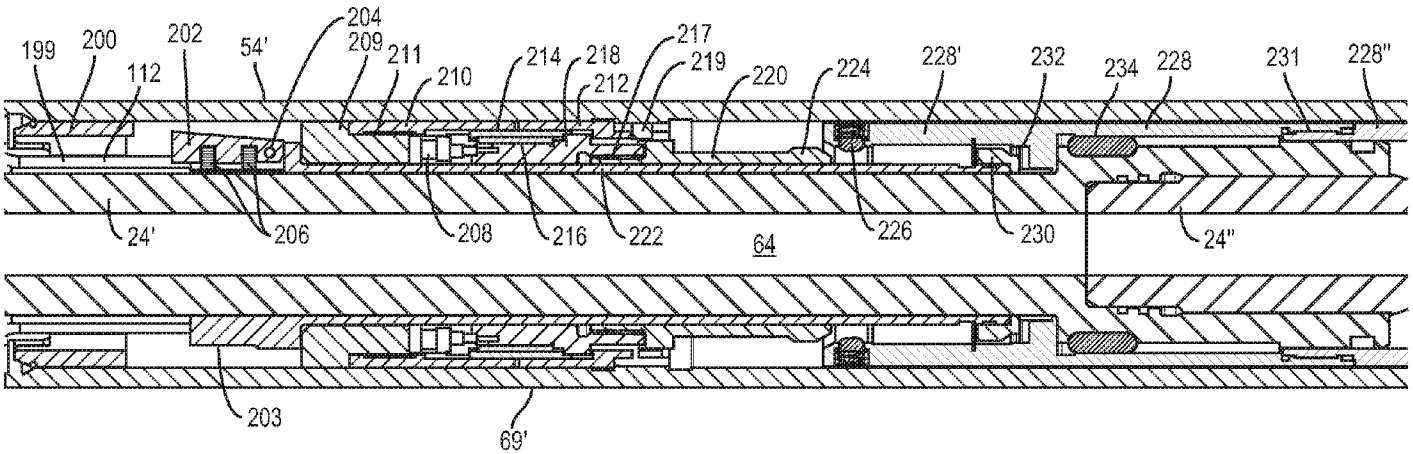
FIG. 15 is a longitudinal cross section through the portion of the apparatus enclosed by rectangle XV in FIG. 13.
Figure 21:
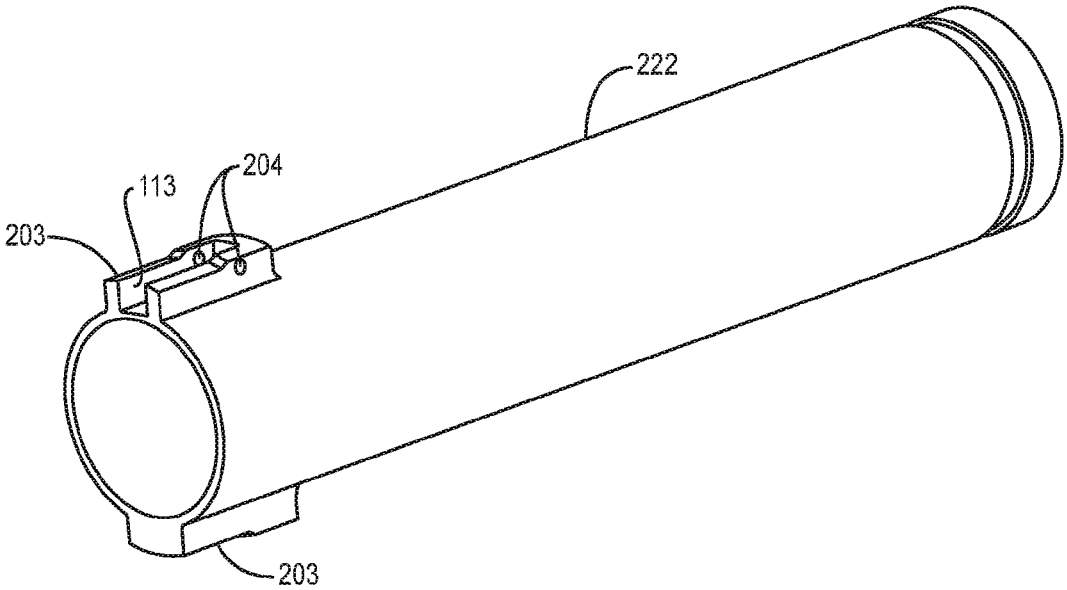
FIG. 21 is an isometric view of the orientation sleeve shown in FIG. 15.

As shown in FIG. 15, an orientation sleeve 222 is mounted so that it can translate along the shaft upper section 24' but is rotationally fixed to the slots 112 in the stop ring 199. As shown in FIG. 21, the orientation sleeve 222 has two lugs 203, one of which contains a slot 113 formed on its uphole end. As shown in FIGS. 15 and 19, a latch key 202 is pivotally mounted by pivot pins 204 in slot 113. A pair of compression springs 206 bias the latch key 202 radially outward. The latch key 202 and opposing lug 203 slide within the opposing slots 112 in the stop ring 199 so that the circumferential orientation of the latch key is the same as that of the stop ring and likewise establishes the "reference" orientation for the bend in the flexible housing 34.

A harmonic drive cap 209 is mounted over the orientation sleeve 222 and is axially supported by a thrust bearing 208. The lugs on the drive cap 209 locate into the end of the slots 112 in stop ring 199 so that it is held in the same radial orientation as the orientation sleeve. The drive cap 209 is coupled by a threaded joint 211 to the circular spline 210 of harmonic drive 69.' Similar to harmonic drive 69 discussed above, harmonic drive 69' comprises the circular spline 210, a flex spline 214, which is supported on needle rollers 216, a wave generator 218, and a circular drive 212. The wave generator 218 is coupled by a threaded joint 217 to a wave generator extension 220 so that the wave generator extension rotates with the wave generator. When the components are axially aligned, splines 224 formed on the downhole end of a wave generator extension 220 are engaged by a spring loaded pin 226 disposed at the uphole end of the piston 228. As a result, when, in order to effect an adjustment to the tool face of the flexible housing 34, the piston 228 is axially displaced in the uphole direction (toward the left in FIG. 15) from its position shown in FIG. 15, the pin 226 engages the splines 224 so that rotation of the piston 228, which is driven by rotation of the drive shaft 24, drives rotation of the wave generator extension 220 and thence the wave generator 218.

The wave generator 218 is essentially the input of the harmonic drive 69' since it is driven by rotation of the shaft 24' when the piston 228 engages the wave generator extension 220 when the tool face is to be adjusted, as explained below. The circular drive 212 is essentially the output of the harmonic drive 69' since, when the piston 228 engages the wave generator extension 220, the circular drive rotates the housing 54', via lug 219, and thence the rotation of the flexible housing 34. Due to the rotation around rotating joint 73, shown in FIG. 14, rotation of the circular drive 212 results in adjustment to the tool face of the flexible housing by rotating the flexible housing 34 relative to the eccentric mass assembly 28, which as previously discussed maintains a constant tool face orientation. Like the harmonic drive 69, the harmonic drive 69' preferably has a high reduction ratio, for example, 160:1.

Figure 16:
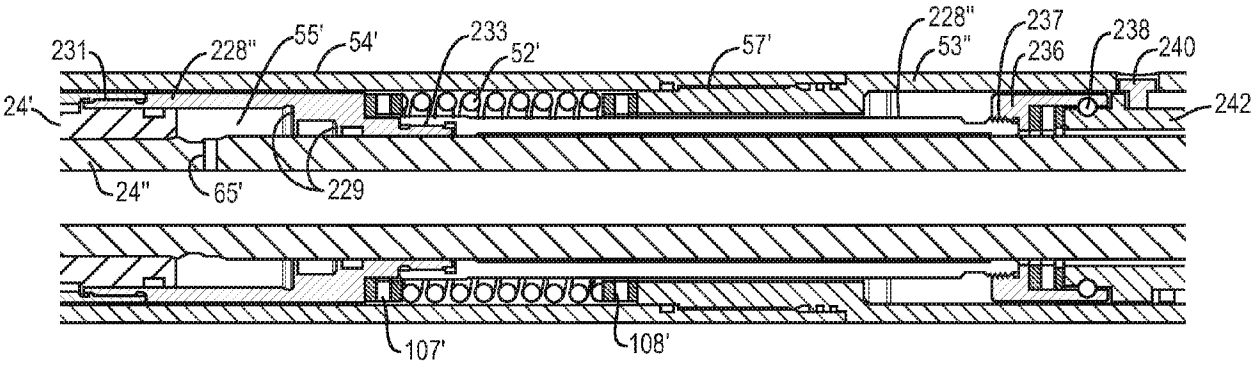
FIG. 16 is a longitudinal cross section through the portion of the apparatus enclosed by rectangle XVI in FIG. 13.

As shown in FIGS. 15 and 16, a piston 228, which is comprised of section 228', 228" and 228'" coupled together via threaded joints 231 and 233, is axially slidably mounted on the drive shaft 24 and is rotationally driven by the drive shaft via mating splines 234. As shown in FIG. 16, a spring 52' biases the piston 228 in the uphole direction (to the left in FIG. 16) toward the wave generator extension 220. Preferably thrust washers 107' and 108' are disposed on either side of the spring 52'.

During normal drilling, the surface mud pump 18 is operated to drive drilling fluid through a central passage 64 in the drive shaft 24 to the drill bit 13. A radial passage 65' connects the central passage 64 to a piston chamber 55'. When the mud pump 18 is operating during normal drilling, the drilling mud pressurizes the chamber 55' and acts on the uphole face 229 of piston section 228" to drive the piston 228 in the downhole direction (to the right in FIG. 16). The spring constant of the spring 52' and size of the piston face 229 are selected such that the force generated by the pressure of the drilling mud during normal drilling is sufficient to overcome the opposing force of the spring 52' so that the uphole end of the piston 228 is axially displaced from the drive splines 224 formed on the downhole end of the wave generator extension 220, as shown in FIG. 15. As a result, during normal drilling, the drive shaft 24 is uncoupled from the harmonic drive 69' and downhole portion of the drill string in which the flexible housing 34 is mounted so that the flexible housing does not rotate during normal drilling, as previously discussed in connection with the embodiment shown in FIGS. 6 and 7.

As shown in FIGS. 16 and 17, housing 54' is coupled by a threaded joint 57' to the stabilizer housing 53" of the upper stabilizer 32'. The downhole end of the stabilizer housing 53" is coupled to the uphole end of the flexible housing 34 so that the flexible housing rotates with the stabilizer housing.

Figure 22:
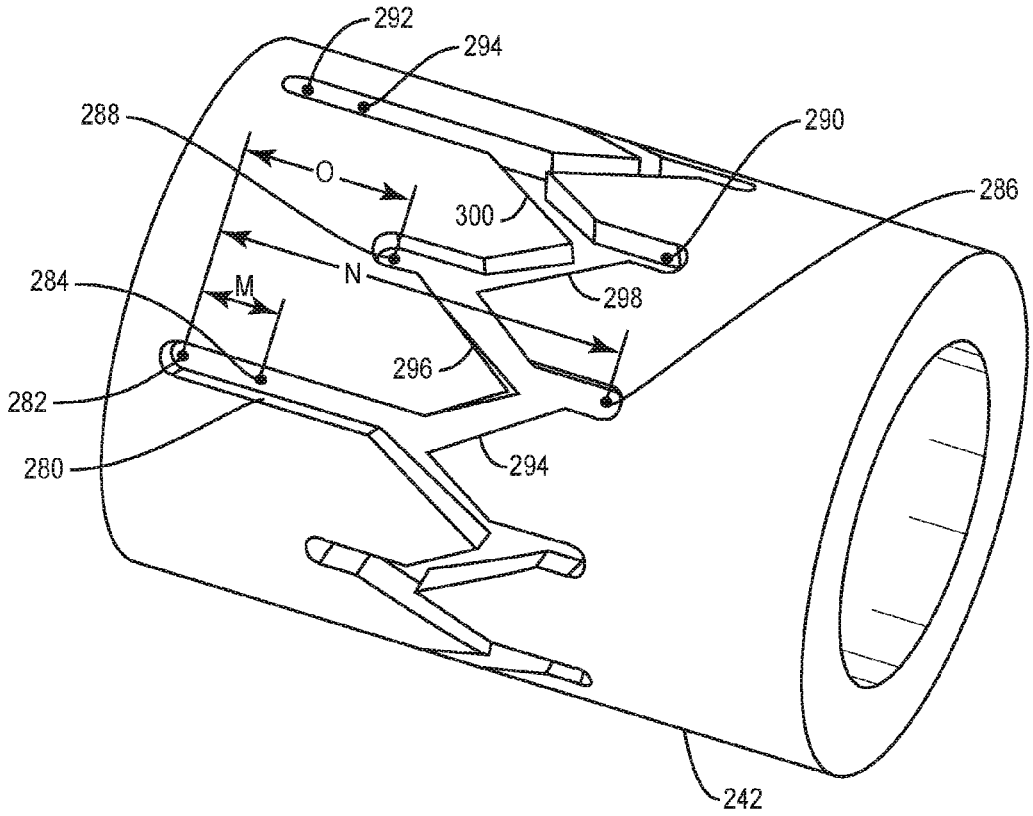
FIG. 22 is an isometric view of the controller barrel shown in FIG. 17.

As shown in FIG. 16, the downhole end of the piston 228 is coupled via a threaded joint 237 to a piston coupling 236 so that the piston coupling rotates with the piston. The piston coupling 236 is rotatably coupled to the uphole end of a controller barrel 242, a portion of which is shown in FIG. 22, via balls 238 disposed within mating grooves of the piston coupling and controller barrel. As a result, the controller barrel 242 can rotate relative to the piston coupling 236, and therefore the piston 228, but is axially locked to it so that the piston coupling 236, piston 228 and controller barrel translate axially as an assembly. The downhole end of the controller barrel 242 is similarly rotatably coupled via balls 238' to a drive pin ring 248, as shown in FIG. 17. As described more fully below, a controller pin 240 disposed in the stabilizer housing 53" projects into a slot 280 in the controller barrel 242. Thrust bearings 107" and 108" are disposed on either end of the controller barrel 242.

As also shown in FIG. 17, a spring loaded engagement pin 246 mounted in the drive pin ring 248 engages drive splines 244 formed on the drive shaft 24. As a result, when, in order to adjust the degree of bend in the flexible housing 34, the engagement pin 246 is axially positioned so as to engage the splines 244, the rotation of the drive shaft 24 drives rotation of the drive pin 246 and thence the drive pin ring 248. The drive pin ring 248 drives rotation of an input shaft 252 of a planetary gear assembly 256. A pin 254 disposed in the stabilizer 32' prevent axial motion of the input shaft with respect to the stabilizer but allows for relative rotation between the input shaft and the stabilizer.

Figure 24:
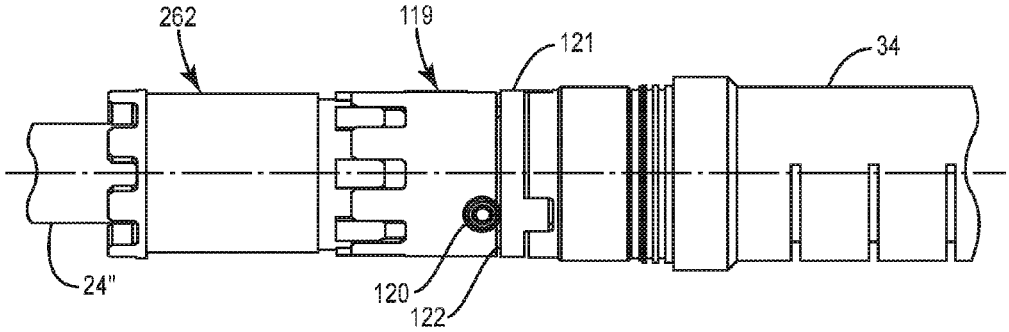
FIG. 24 is a view of the cam follower section of the apparatus shown in FIG. 17.

As is conventional, the planetary gear assembly 256 is comprised of series of planetary gear stages, three such stages are shown in FIG. 17, so as to effect a high gear ratio. An output shaft 260 of the planetary gear assembly 256 drives the rotation of a centralizer piece 262, which is supported on roller bearings 264 within a bushing 266. In the embodiment shown in FIGS. 17 and 24, the centralizer piece 262 engages and drives a cam follower carrier 119. A thrust bearing 118 is located between the cam follower carrier 119 and the tension tube 42". Rotation of the cam follower carrier 119 causes cam followers 120, mounted on the carrier, to follow a cam surface 122 formed in a cam profile ring 121. As a result, rotation of the cam follower carrier 119 by the planetary gear assembly 256 causes axial displacement of the tension tube 42". The displacement of the tension tube 42" imposes compression on the flexible housing 34, as before.

Although a planetary gear assembly 256 and a cam surface 122 and cam follower 120' are used in connection with the bending assembly 91" shown in FIG. 17, alternatively, a harmonic drive such as harmonic drive 90 and/or a threaded nut arrangement, such as nut 42, shown in connection with the embodiment depicted in FIG. 8 could be used to adjust the degree of bending of the flexible housing.

Figure 23A:
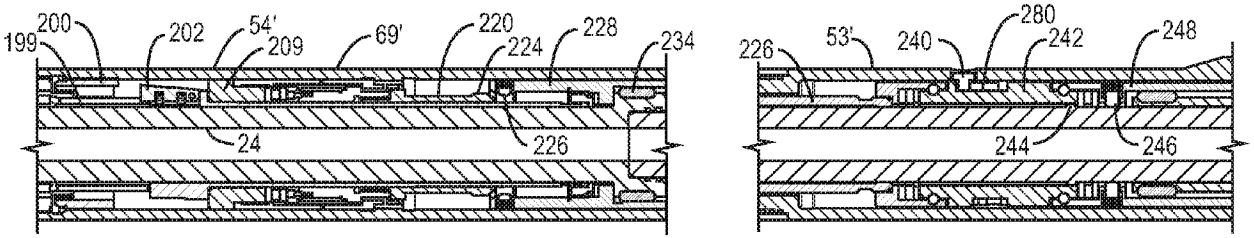
FIG. 23A through D shown the relationship of the components of the steering apparatus in various modes—A shows the normal drilling mode, B shows the mode in which the tool face angle can be adjusted, C shows the mode in which the tool face angle of the flexible housing is rotated into a known reference orientation, and D shows the mode in which the degree of bend in the flexible housing can be adjusted.

The operation of the embodiment of the steering apparatus 10' will now be discussed with reference to FIGS. 23A-D. FIG. 23A shows relative positioning of the components when the steering apparatus 10' is in the normal drilling mode. In this mode, drill mud pressurizes the piston chamber 55' drives the piston 228 downhole (to the right in FIG. 23) against the force of the sprint 52', as shown in FIG. 16. As a result, the pin 226 in the uphole end of the piston 228, whose rotation is driven by the shaft 24 via the splines 234, does not engage the splines 224 in the downhole end of the wave generator extension 220, as shown in FIG. 23A. Consequently, the harmonic drive 69' is not driven by the drive shaft 24 in this mode so that the circumferential orientation of the assembly of the orientation ring 200, housings 54' and 53" and, ultimately, the flexible housing 34 remains unchanged with respect to the eccentric mass assembly 28—in other words, the tool face of the bend in the flexible housing 34 and, therefore, the direction in which the drill bit 13 is steered remains constant. Similarly, as also shown in FIG. 23A, the pin 246 in the drive pin ring 248 does not engage the spines 244 in the shaft 24. As a result, the drive ring 248 does not drive the planetary gear 256 (shown in FIG. 17) so that the axial position of the tension tube 42' remains the same and the degree of bending in the flexible housing 34—and, therefore, the degree of the change in the direction of drilling—remains unchanged in the normal drilling mode.

As shown in FIG. 22, a more or less cyclic serpentine slot 280, which can be viewed as a series of J-slots, is formed around the circumference of the controller barrel 242. Each "cycle" of the slot 280 has five positions 282, 284, 286, 288, and 290 at which the controller pin 240 may be located. When in the drilling mode shown in FIG. 23A, the downhole (rightward) position of the piston 228 pushes the controller barrel 242 in the downhole (rightward) direction, via the piston coupling 236. As a result, the controller pin 240 is in the first position 282, which is the extreme uphole position in the slot 280.

Figure 23B:
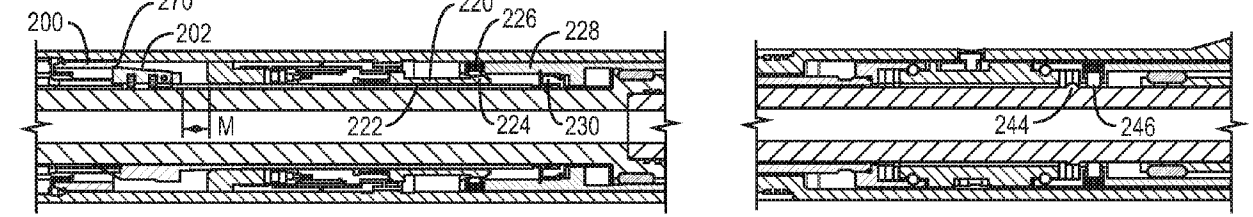

FIG. 23B shows the tool face adjustment mode—that is, the mode in which an adjustment can be made to the tool face of the flexible housing 34 in order to effect a change in the direction of drilling. The tool face adjustment mode can be obtained by shutting down the mud pump 18. When the mud pump 18 is turned off, the reduction in pressure in the piston chamber 55' allows the spring 52 to drive the piston 228 in the uphole (leftward) direction. The piston 228, through the orientation sleeve lug 230 drives the orientation sleeve 222 in the uphole direction (leftward). The travel of the orientation sleeve 222 in the uphole (leftward) direction is stopped when the edge of the latch key 202 contacts the face 270 of the orientation ring 200. As shown in FIG. 23B, in going from the normal drilling mode to the tool face adjustment mode, the orientation sleeve 222 is displaced a distance M in the uphole (leftward) direction with respect to the harmonic drive cap 209, whose axial position is fixed with respect to the housing 54'.

When the piston 228 is in the position shown in FIG. 23B, the pin 226 in the piston engages the splines 224 in the wave generator extension 220, which is the input to the harmonic drive 69'. Rotation of the drive shaft 24, which drives rotation of the piston 228, will now drive rotation of the harmonic drive 69'. As previously discussed, the output of the harmonic drive 69' is the circular drive 212, which drives rotation of housing 54' via the lug 219. Rotation of the housing 54' causes rotation of the stabilizer housing 34' which, in turn, rotates the flexible housing 34. Rotation of the flexible housing 34 changes the circumferential orientation of the bend in the flexible housing relative to the eccentric mass assembly 28. Thus, in the mode shown in FIG. 23B, the tool face angle of the bend in the flexible housing 34 and, therefore, the direction of drilling can be adjusted by rotation of the drive shaft 24 from the surface.

Note that in this mode, the uphole displacement of the piston 228 and, therefore, the controller barrel 242 and drive pin ring 248 to which it is axially, although not rotationally, coupled, is not sufficient to cause the pin 246 in the drive pin ring 248 to engage the splines 244 in the drive shaft 24. Therefore, in this mode, rotation of the drive shaft 24 does not drive the planetary gear 256 and, therefore, does not alter the degree of bending in the flexible housing 34. The uphole displacement of the piston 228 by distance M also displaces the controller barrel 242 by distance M relative to the controller pin 240 so that the controller pin 240 is now in position 284 in the slot 280, as shown in FIG. 22.

To return to normal drilling after the desired adjustment in the tool face of the flexible housing 34 has been accomplished, the mud pump 18 can be restarted, placing the steering apparatus back into the drilling mode shown in FIG. 23A, in which rotation of the drive shaft 24 does not further alter the tool face angle of the flexible housing 34. The controller barrel 242 is displaced so as to return to the position in which the controller pin 240 is at position 282 in the slot 280.

As previously discussed, since the gear ratio of the harmonic drive 69' or other reduction gear used to effect adjustment of the flexible housing tool face angle is known, by keeping accurate track of the number of rotations of the drive shaft 24 when in the tool face adjustment mode, one can determine the tool face angle of the flexible housing 34. However, after repeated adjustments, it may be difficult to precisely determine the tool face angle in this manner because of backlash or other inaccuracies in the system. Difficulty in keeping track of tool face can also result from incorrect counting of the required drill string turns to set the tool, rotating the drill string when the pumps are off, rotating the drill string with the drilling pressure below the required set drilling pressure, drill string wash outs, stuck drilling assembly, poor practices during connections, trip in or out or hole, or any unrecorded rotation of the drill string when the pumps are not running.

Consequently, according to a preferred embodiment of the invention, the steering apparatus can be placed into a "reference orientation" in which the orientation of the bend in the flexible housing 34 relative to the eccentric mass assembly 28, and therefore, the tool face angle of the flexible housing, is known (as previously discussed, as a result of gravity, the eccentric mass is always oriented at the low side of the bore hole 17).

Figure 23C:
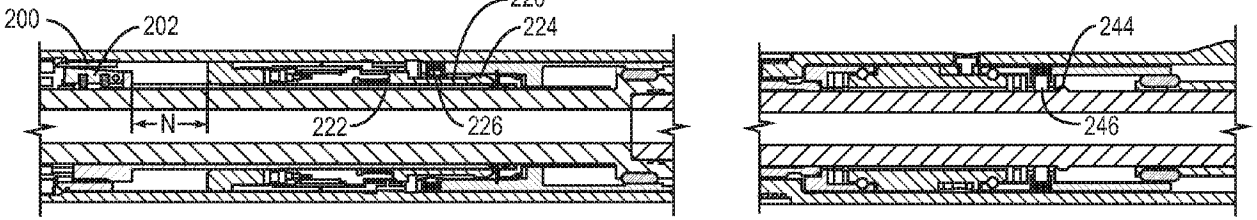

FIG. 23C shows the reference orientation mode—that is, the mode in which the bend in the flexible housing 34 is oriented at a known tool face angle. As discussed above, when the mud pump 18 is turned off, the steering apparatus 10' is initially placed into the mode shown in FIG. 23B in which the piston 228 drives the latch key 202 against the downhole face 270 of the orientation ring 200. In this mode, rotation of the drive shaft 24 causes rotation of the harmonic drive 69' and, therefore, rotation of the housing 54', as previously discussed. Rotation of the housing 54' also causes rotation of the orientation ring 200 to which it is fixed. As shown in FIG. 20, a projection 276 is formed in the downhole face 270 of the orientation ring 200. A surface 272 on the side of the projection 276 acts as a ramp. Since the uphole face of the latch key 202 bears against the orientation ring face 270 when the apparatus is in the mode shown in FIG. 23B, rotation of the orientation ring 200 in the counterclockwise direction (looking uphole) eventually causes the ramp 276 to come into contact with the uphole edge of the latch key 202. Ramp 276 presses the latch key radially inward so that it rotates around pivot 204 (in the counterclockwise direction in FIG. 15) against the bias force of the springs 206. Further rotation of the orientation ring 200 aligns the slot 274 in the orientation ring with the latch key 202. This allows the latch key 202 to slide into the slot 274 in the orientation ring 200, and further into the slot 112 in the stop ring 199, so that the piston 228 can drive the orientation sleeve 222 further in the uphole (leftward) direction, placing the steering apparatus into the mode shown in FIG. 23C.

As shown in FIG. 23C, in this mode, the orientation sleeve 222 is displaced by distance N in the uphole (leftward) direction with respect to the harmonic drive cap 209. This further displacement of the piston 228 disengages the pin 226 in the piston 228 from the splines 224 in the wave generator extension 220 so that rotation of the drive shaft 24 will not drive the harmonic drive 69'. Although the displacement of the piston 228 also displaces the drive pin ring 248, the spring loaded pins 246 are displaced a sufficient distance as to move passed the splines 224 in the drive shaft 24 and finish on the uphole side of splines 224. Thus, rotation of the drive shaft 24 does not result in a change in the degree of bend in the flexible housing 34.

Since the circumferential orientation of the latch key 202 (and the slot 112 in the stop ring 199) is rotationally fixed with respect to the eccentric mass assembly 28 so as to be in the same circumferential orientation as the eccentric mass assembly, and the orientation of the slot 274 is orientation ring 200 is rotationally fixed with respect to the flexible housing 34, entry of the latch key 202 into the slot 274 in the orientation ring 200 means that the circumferential orientation of the bend in the flexible housing is now in a known "reference" orientation. For example, if the latch key 202 is set so as to be aligned with the eccentric mass assembly 28, which is always oriented at the low side of the bore hole, placing the bend in the flexible housing 34 into the reference orientation means that the bend is also oriented to the low side of the bore hole.

Note that, after the mud pump 18 is stopped, thereby placing the steering apparatus into the mode shown in FIG. 23B, the drill rig operator need not know how many rotations of the drive shaft 24 are necessary to orient the slot 274 with the latch key 202. Rather, the operator need only know that there is a minimum number of rotations that will orient the slot 274 with the latch key 202 no matter what the initial orientation of the bend in the flexible housing 34 when the drilling is stopped. For example, if the gear ratio of the harmonic drive 1:160, rotating the drive shaft 24 one hundred sixty revolutions—in other words, 360°—will guarantee orientation of the slot 274 with the latch key 202. Note that the operator need not be concerned with over rotating the shaft 24 since once the slot 274 is aligned with the latch key 202, it is driven into the slot by the piston 228, thereby displacing the piston further in the uphole direction and placing the apparatus into the mode shown in FIG. 23C, which results in disengaging the drive shaft from the harmonic drive 69'. Thus, once the orientation ring 200 is placed in the reference orientation, further rotation of the drive shaft 24 does not alter the orientation of the orientation ring 200.

Note that when the piston 228 is displaced by distance N in the mode shown in FIG. 23C, the controller barrel 242 is displaced so that the controller pin 240 is located at position 286, shown in FIG. 22. Position 286 of the slot 280 is circumferentially displaced from position 282 so that the slot forms a ramp 294. As the slot 280 moves along the controller pin 240, the ramp 294 in the slot comes into contact with the pin, thereby driving rotation of the controller barrel 242.

Figure 23D:
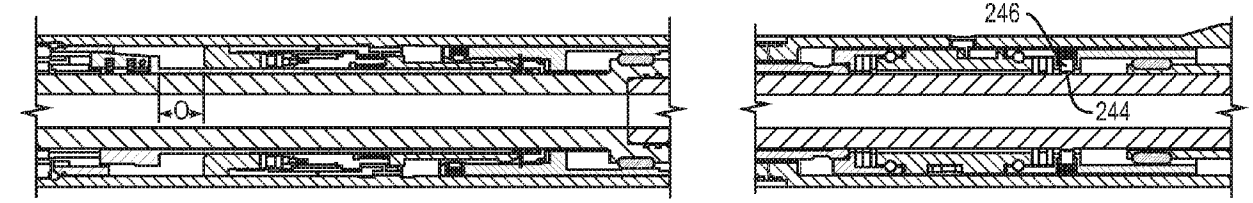

FIG. 23D shows the bend setting mode—that is, the mode in which the degree of bending in the flexible housing 34 is adjusted. When the mud pump 18 is restarted after placing the steering apparatus into the mode shown in FIG. 23C, the pressure in chamber 55' will drive the piston 228 and the controller barrel 242 in the down hole (rightward) direction. However, because the controller pin 240 had rotated the controller barrel 242 so that the pin was located at position 286 when in the reference mode, the subsequent downhole displacement of the controller barrel will cause the pin to contact ramp 296 when the controller barrel is displaced downhole, thereby again rotating the controller barrel until the controller barrel is displaced so that the pin is at position 288, which is circumferentially displaced from position 286. This will place the apparatus into the mode shown in FIG. 24D. In this mode the orientation sleeve 222 is displaced by distance O from the harmonic drive cap 209, which is between distance M and distance N. As a result, the pin 226 in the piston 228 does not engage the splines in the wave generator extension 220 so that the harmonic drive 69' is not engaged and rotation of the drive shaft 24 does not alter the circumferential orientation of the bend in the flexible housing 34. However, the pin 246 in the drive pin ring 248 now engages the splines 224 on the drive shaft 24 so that rotation of the drive shaft drives rotation of the planetary gear 256. Thus, when the steering apparatus is in the mode shown in FIG. 23D, rotation of the drive shaft 24 alters the degree of bending of the flexible housing 34. For example, rotation of the drive shaft 24 in the clockwise direction may increase the degree of bending, whereas rotation in the counterclockwise direction may decrease the degree of bending. Note that in this mode, the latch key 202 is not fully withdrawn from the slot 274 in the orientation ring 200 so that the tool face angle of the bend in the flexible housing 34 remains in the reference orientation.

When the mud pump 18 is shut down following operation in the bending setting mode (FIG. 23D), the pressure in the piston chamber 55' will decrease and the force of the spring 52' will drive the piston 228 and, hence, the controller barrel 242, in the uphole direction (to the left). The displacement of the controller barrel 242 will cause the controller pin 240 to contact ramp 298 of the slot 280, thereby rotating the controller barrel another increment so that pin is at position 290. As a result, the steering apparatus will be placed back into the reference orientation mode shown in FIG. 23C.

When the mud pump 18 is then restarted, the controller barrel 242 will be displaced to the right so that the controller pin 240 contacts the ramp 300 in the slot 280 thereby incrementing the rotation of the controller barrel and placing the pin in position 292. This places the steering apparatus into the normal drilling mode shown in FIG. 23A. It should be noted that position 292 represents the initial starting position of the next cycle of the slot 280, corresponding to position 282 of the prior cycle.

The use of the operating modes discussed above allows both the tool face angle of the bend in the flexible housing 34 and the degree of bending in the flexible housing to be adjusted accurately and efficiently without removing the drill string from the bore hole 17. For example, if after drilling for a period of time in the normal drilling mode (FIG. 23A, controller pin 240 in position 282 of the controller barrel 242), a slight adjustment is desired in the drilling direction, the mud pump 18 can be shut down, thereby placing the apparatus into the tool face adjusting mode (FIG. 23B, controller pin 240 in position 284). With the apparatus in the tool face adjusting mode, rotation of the drive shaft 24 will result in rotation of the bend in the flexible housing 34 relative to the eccentric mass, which has a known orientation—the low side of the bore hole 17. The number of revolutions of the drill string 24 necessary to achieve a given adjustment in the tool face angle of the bend in the flexible housing 34 will depend on the gear ratio of the harmonic drive 69'. If the tool face angle of the bend in the flexible housing 34 was 10° and the gear ratio of the harmonic drive 96' was 100:1, then rotating the drive shaft 24 while in the tool face adjusting mode by ten revolutions would alter the tool face angle by +36° to 46°. Restarting the mud pump 18 after the adjustment would place the apparatus back into the normal drilling mode so that drilling could commence in the new direction.

According to the preferred embodiment of the invention discussed above, the tool face angle of the bend in the flexible housing 34 could be adjusted without regard to the existing tool face angle by stopping and restarting the mud pump 18 as well as rotating the drive shaft 24 in a predetermined sequence. The procedure would be as follows:

1. Shut down the mud pump 18, thereby placing the apparatus into the tool face adjusting mode shown in FIG. 23B, with the controller pin 240 at position 284.

2. Rotate the drive shaft 24 a minimum number of revolutions, for example a number of revolution sufficient to achieve 360° of rotation of the orientation ring 200, to ensure that the slot 274 in the orientation ring had become oriented with the latch key 202, thereby causing the apparatus to be placed in the reference orientation mode (FIG. 23C, controller pin 240 in position 286).
3. Restart the mud pump 18 so as to place the apparatus into the mode shown in FIG. 23D, with the controller pin 240 at position 288. The latch key 202 remains in the orientation ring slot 274 so that the tool face angle of the bend in the flexible housing 34 remains in the reference orientation.
4. Shut down the mud pump 18 so as to place the apparatus back into the mode shown in FIG. 23 C, with controller pin 240 in position 290.
5. Restart the mud pump 18, thereby placing the apparatus into the mode shown in FIG. 23A, with the controller pin 240 in position 292. Since the drive shaft 24 has not been rotated, the latch key 204 is now withdrawn from the orientation ring slot 274 but the tool face of the bend in the flexible housing 34 still remains in the reference orientation.
6. Shut down the mud pump 18 so as to place the apparatus into the tool face setting mode shown in FIG. 23B, with the pin in position 292. Since the tool face angle of the bend in the flexible housing 34 is now known to be in the reference orientation, the number of revolutions necessary to achieve the desired tool face angle can be accurately determined. Thus, if, in the example above in which it was desired to drill with a tool face angle of 36°, the harmonic drive 69' had a gear ratio of 100:1 and the reference orientation of the bend in the flexible housing was 0° from the center of the eccentric mass—in other words, at the high side of the bore hole 17—then the drive shaft 24 would be rotated 360° degrees (10 revolutions), which would result in displacement of the bend in the flexible housing 34 by 36° from the reference orientation.
7. Restart the mud pump 18 so as to place the apparatus into the normal drilling mode shown in FIG. 23A with the controller pin 240 in position 292 and begin drilling in the new direction.

If it were desired to adjust the degree of bending in the flexible housing 34, steps 1 through 3 above would be performed, but after the mud pump 18 were restarted in step 3 and the controller pin 240 in position 288, the drive shaft 24 would be rotated so as to drive rotation of the planetary gear 256 and thereby adjust the degree of bending. Steps 4 through 7 would then be repeated to return the tool face angle to the prior setting or to a new setting, as desired.

Although the preferred embodiment of the invention has been described with reference to a rotary steering apparatus that permits in situ adjustment of both the tool face angle of the bend and the amount of bending, the invention may be practiced by incorporating only one of these features into the bottom hole assembly, employing more conventional methods for the other adjustment.

Preferably, adjustment of the tool face angle of the bend is accomplished by an orientation section 71 that includes a mechanism for rotating the bent portion of the bottom hole assembly relative to a reference orientation established by the eccentric mass 28. The mechanism for rotating the bent portion of the bottom hole assembly preferably, but need not, include a reduction gear. While in the embodiments described above the orientation section reduction gear is a harmonic drive, other reduction gears, such as planetary gears, could also be used.

Preferably, adjustment of the amount of bending in the bottom hole assembly is accomplished by applying compression to a portion of the bottom hole assembly that is preferentially weakened so as to bend in a predetermined orientation. The mechanism for applying the compression preferably, but need not, include a reduction gear, such as a harmonic drive or planetary gear.

According to the preferred embodiment of the invention, both the adjustment of the tool face angle of the bend in the bottom hole assembly and the adjustment of the amount of the bend in the bottom hole assembly can be accomplished by controlling the mud flow and rotating the shaft 24 driving rotation of the drill bit 13.

According to one embodiment of the invention, the tool face of the bend in the bottom hole assembly can be placed in a known reference orientation from which the desired tool face is then set. Although this embodiment was described in connection with a steering apparatus that employed a bend in the bottom hole assembly to effect steering, the method of establishing a reference orientation could be used with other types of steering apparatus, such as those incorporating an offset to the drill bit.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

What is claimed:

1. An apparatus for steering a drill bit used to drill a bore hole in an earthen formation, said apparatus forming a portion of a bottom hole assembly of a drill string to which said drill bit is coupled, said steering apparatus comprising:

(a) a bendable member adapted to be incorporated into said bottom hole assembly, said bendable member having a preferential direction in which said bendable member bends, wherein the amount of bending of said bendable member in said preferential direction determines the degree of change in the direction of said drilling; and (b) means for adjusting in situ the amount of said bending of said bendable member in said preferential direction so as to adjust the degree of directional change in said drilling.

2. The steering apparatus according to claim 1, wherein said bendable member bends in said preferential direction as a result of the application of force to said bendable member.

3. The steering apparatus according to claim 1, wherein said bendable member bends in said preferential direction as a result of the application of a compressive force to said bendable member.

4. The steering apparatus according to claim 3, wherein bendable member comprises at least one weakening feature causing said bendable member to bend in said preferential direction when a force is applied to said bendable member.

5. The steering apparatus according to claim 4, wherein bendable member comprises a flexible housing and wherein said weakening feature comprises at least one cut in said flexible housing extending around a portion thereof.

6. The steering apparatus according to claim 4, wherein said weakening feature comprises an area of locally reduced thickness of said bendable member.

7. The steering apparatus according to claim 3, wherein said means for adjusting in situ said amount of bending of said bendable member comprises means for applying a compressive force to said bendable member.

8. The steering apparatus according to claim 7, wherein said means for applying a compressive force to said bendable member comprises (i) a force applying member in contact with said bendable member and (ii) means for displacing said force applying member relative to said bendable member so that said force applying member applies a compressive force to said bendable member.

9. The steering apparatus according to claim 8, wherein said force applying member comprises a tube placed in tension in order to apply a compressive force to said bendable member.

10. The steering apparatus according to claim 8, wherein rotation of said drill bit is driven by a drive shaft coupled to said drill string, and wherein said means for displacing said force applying member is coupled to and driven by said drive shaft.

11. The steering apparatus according to claim 10, wherein said means for displacing said force applying member is coupled to said drive shaft by a reduction gear.

12. The steering apparatus according to claim 11, wherein said reduction gear comprises a harmonic drive.

13. The steering apparatus according to claim 11, wherein said reduction gear comprises epicyclic gearing.

14. The steering apparatus according to claim 11, wherein said means for displacing said force applying member comprises a threaded member coupling said reduction gear to said force applying member.

15. The steering apparatus according to claim 8, wherein said means for displacing said force applying member comprises a cam follower and a cam surface.

16. The steering apparatus according to claim 1, wherein rotation of said drill bit is driven by a drive shaft coupled to said drill string, and wherein said means for adjusting in situ the amount of said bending of said bendable member is driven by said drive shaft.

17. The steering apparatus according to claim 1, further comprising means for adjusting in situ the tool face angle of said bendable member so as to adjust the direction of said drilling.

18. The steering apparatus according to claim 17, wherein said means for adjusting in situ the tool face angle of said bendable member comprises means for rotating said bendable member with respect to a portion of said drill string uphole of said bendable member.

19. The steering apparatus according to claim 18, wherein rotation of said drill bit is driven by a drive shaft extending through said drill string, and wherein said means for rotating said bendable member is coupled to and driven by said drive shaft.

20. The steering apparatus according to claim 19, wherein said means for rotating said bendable member comprises a reduction gear coupling said bendable member to said drive shaft.

21. The steering apparatus according to claim 20, wherein said reduction gear comprises a harmonic drive.

22. The steering apparatus according to claim 20, wherein said reduction gear comprises epicyclic gearing.

23. The steering apparatus according to claim 17, wherein said means for adjusting in situ the tool face angle of said bendable member comprises (i) means for establishing a reference tool face angle, and (ii) means for rotating said bendable member relative to said means for establishing said reference tool face angle.

24. The steering apparatus according to claim 23, wherein said means for establishing said reference tool face angle comprises an asymmetrically weighted member.

25. An apparatus for steering a drill bit used to drill a bore hole in an earthen formation, said apparatus forming a portion of a bottom hole assembly of a drill string in which said drill bit is coupled to a drive shaft, said steering apparatus comprising:

(a) a bendable member adapted to be incorporated into said bottom hole assembly, said bendable member having a preferential direction in which said bendable member bends when a force is applied to said bendable member, wherein the amount of bending of said bendable member in said preferential direction determines the degree of change in the direction of said drilling; and (b) a force applying member adapted to be mounted in said bottom hole assembly, the force applying member comprising a tension member configured to apply a compressive force to the bendable member so as to bend said bendable member in said preferential direction, said force applying member coupled to said drive shaft so that rotation of said drive shaft causes said tension member to apply said compressive force to said bendable member that bends said bendable member in said preferential direction.

26. The steering apparatus according to claim 25, wherein said bendable member comprises a flexible housing adapted to be mounted in said bottom hole assembly uphole of said drill bit.

27. The steering apparatus according to claim 25, wherein said bendable member has at least one weakening feature incorporated therein.

28. The steering apparatus according to claim 27, wherein said weakening feature comprises at least one cut extending around a portion of said bendable member.

29. The steering apparatus according to claim 27, wherein said weakening feature comprises an area of locally reduced thickness of said bendable member.

30. The steering apparatus according to claim 25, wherein said drive shaft is coupled to said force applying member by a reduction gear.

31. The steering apparatus according to claim 30, wherein said reduction gear comprises a harmonic drive.

32. The steering apparatus according to claim 30, wherein said reduction gear comprises epicyclic gearing.

33. The steering apparatus according to claim 25, wherein said bendable member bends in said preferential direction when a compressive force is applied to said bendable member, and wherein said force applying member applies a compressive force to said bendable member.

34. The steering apparatus according to claim 25, wherein said tension member comprises a tube arranged approximately coaxially with said bendable member.

35. The steering apparatus according to claim 25, wherein rotation of said drive shaft causes displacement of said force applying member.

36. The steering apparatus according to claim 35, further comprising a threaded member coupling said drive shaft to said force applying member, wherein rotation of said threaded member causes displacement of said force applying member.

37. The steering apparatus according to claim 35, further comprising a cam and a cam surface adapted to cause said displacement of said force applying member.

38. The steering apparatus according to claim 25, further comprising means for adjusting in situ the tool face angle of said bendable member so as to adjust the direction of said drilling.

39. The steering apparatus according to claim 38, wherein said means for adjusting in situ the tool face angle of said bendable member comprises means for rotating said bendable member with respect to a portion of said drill string uphole of said bendable member.

40. The steering apparatus according to claim 39, wherein said means for rotating said bendable member is coupled to and driven by said drive shaft.

41. The steering apparatus according to claim 40, wherein said means for rotating said bendable member comprises a reduction gear coupling said bendable member to said drive shaft.

42. The steering apparatus according to claim 41, wherein said reduction gear comprises a harmonic drive.

43. The steering apparatus according to claim 41, wherein said reduction gear comprises epicyclic gearing.

44. The steering apparatus according to claim 38, wherein said means for adjusting in situ the tool face angle of said bendable member comprises (i) means for establishing a reference tool face angle, and (ii) means for rotating said bendable member relative to said means for establishing said reference tool face angle.

45. The steering apparatus according to claim 44, wherein said means for establishing said reference tool face angle comprises an asymmetrically weighted member.

46. An apparatus for steering a drill bit used to drill a bore hole in an earthen formation, said apparatus forming a portion of a bottom hole assembly of a drill string to which said drill bit is coupled, rotation of said drill bit being driven by a drive shaft coupled to said drill string, said steering apparatus comprising:

(a) a bendable member adapted to be incorporated into said bottom hole assembly, said bendable member having a preferential direction in which said bendable member bends when a force is applied to said bendable member, said preferential direction in which said bendable member bends being angularly oriented at a first tool face angle with respect to a portion of said bottom hole assembly, wherein the amount of bending of said bendable member in said preferential direction determines the degree of change in the direction of said drilling; and (b) a coupling that couples said drive shaft to said bendable member, the coupling comprising a reduction gear configured such that rotation of said drive shaft changes said first tool face angle of said preferential direction in which of said bendable member bends.

47. The steering apparatus according to claim 46, wherein said reduction gear is a harmonic drive.

48. The steering apparatus according to claim 46, wherein said reduction gear is an epicyclic gear.

49. The steering apparatus according to claim 46, wherein said bendable member comprises a flexible housing adapted to be mounted in said bottom hole assembly uphole of said drill bit.

50. The steering apparatus according to claim 46, wherein said bendable member has at least one weakening feature incorporated therein.

51. The steering apparatus according to claim 46, further comprising an eccentrically weighted member adopted to be rotatably mounted in said bottom hole assembly, wherein said eccentrically weighted member tends to rotate into a circumferential orientation in which said eccentric weight is oriented downward with respect to said earthen formation.

52. The steering apparatus according to claim 51, wherein said drive shaft rotates said bendable member relative to said eccentrically weighted member.

53. A method of steering a drill bit coupled to a drill string having a bottom hole assembly and drilling a bore hole into an earthen formation, said method comprising the steps of:

(a) rotating said drill bit so as to drill said bore hole into said earthen formation in a first direction by rotating a drive shaft coupled to said drill bit while simultaneously pumping a drilling fluid through said drill string at a first flow rate; and (b) changing the direction in which said drill bit drills said bore hole with a bend inducing mechanism that places a bendable member mounted in said bottom hole assembly in compression, thereby bending a bendable portion of said bottom hole assembly in situ in said bore hole.

54. The steering method according to claim 53, wherein said bending of said bendable portion of said bottom hole assembly is effected by rotating said drive shaft while pumping said drilling fluid through said drill string at a second flow rate lower than said first flow rate.

55. The steering method according to claim 54, wherein said second flow rate of drilling fluid is essentially zero.

56. The steering method according to claim 53, wherein said bendable portion of said bottom hole assembly is bent by a bend inducing mechanism disposed in said bottom hole assembly, and wherein said drive shaft drives said bend inducing mechanism through a reduction gear coupling said drive shaft to said bend inducing mechanism.

57. The steering method according to claim 56, wherein said reduction gear is a harmonic drive.

58. The steering method according to claim 56, wherein said reduction gear is an epicyclic gear.

59. The steering method according to claim 56, wherein said driving of said bend inducing mechanism by said drive shaft is effected by biasing a piston coupled to said drive shaft into engagement with said reduction gear.

60. The steering method according to claim 53, wherein said bendable member is placed in compression by placing a tension member coupled to said bendable member in tension.

61. The steering method according to claim 53, further comprising changing the direction in which said drill bit drills said bore hole by rotating said bendable portion of said bottom hole assembly relative to an uphole portion of said bottom hole assembly in situ in said bore hole.

62. A method of steering a drill bit coupled to a drill string having a bottom hole assembly and drilling a bore hole into an earthen formation, said method comprising the steps of:

(a) rotating said drill bit so as to drill said bore hole into said earthen formation in a first direction by rotating a drive shaft coupled to said drill bit while simultaneously pumping a drilling fluid through said drill string at a first flow rate, at least a first portion of said bottom hole assembly having a bend formed therein;

(b) changing the direction in which said drill bit drills said bore hole, wherein:

(i) said change in the direction in which said drill bit drills said bore hole is effected by rotating said first portion of said bottom hole assembly having said bend formed therein relative to a second portion of said bottom hole assembly disposed uphole of said first portion;

(ii) said first portion of said bottom hole assembly having said bend formed therein is rotated relative to a second portion of said bottom hole assembly using a tool face setting mechanism;

(iii) said relative rotation of first portion of said bottom hole assembly is effected by rotating said drive shaft while pumping said drilling fluid through said drill string at a second flow rate lower than said first flow rate, said rotation of said drill string while pumping drilling fluid at said second flow rate causing said drive shaft to drive said tool face setting mechanism so as to rotate said first portion of said bottom hole assembly relative to said second portion.

63. The steering method according to claim 62, wherein said second flow rate of drilling fluid is essentially zero.

64. The steering method according to claim 62, wherein said drive shaft drives said tool face setting mechanism through a reduction gear coupled between said drive shaft and said tool face setting mechanism.

65. The steering method according to claim 64, wherein said drive shaft is caused to drive said tool face setting mechanism by biasing a piston coupled to said drive shaft into engagement with said reduction gear.

66. A steering apparatus configured to steer a drill bit used to drill a bore hole in an earthen formation, the steering apparatus configured to form a portion of a bottom hole assembly of a drill string in which the drill bit is coupled to a drive shaft, the steering apparatus comprising:

(a) a bendable member adapted to be incorporated into the bottom hole assembly, the bendable member having a flexible housing adapted to be mounted in the bottom hole assembly uphole of said drill bit, the bendable member configured to bend in a preferential direction when a force is applied to the bendable member, wherein the amount of bending of the bendable member in the preferential direction determines the degree of change in the direction of the drilling; and (b) a force applying member adapted to be mounted in said bottom hole assembly so as to apply a force to said bendable member that bends said bendable member in said preferential direction, said force applying member coupled to said drive shaft so that rotation of said drive shaft causes said force applying member to apply said force to said bendable member that bends said bendable member in said preferential direction.

67. The steering apparatus according to claim 66, wherein the bendable member has at least one weakening feature incorporated in the flexible housing.

68. The steering apparatus according to claim 67, wherein the weakening feature comprises at least one cut extending around a portion of the bendable member.

69. The steering apparatus according to claim 67, wherein the weakening feature comprises an area of locally reduced thickness of said bendable member.

70. The steering apparatus according to claim 66, further comprising a reduction gear configured to couple the drive shaft is coupled to the force applying member.

71. The steering apparatus according to claim 70, wherein the reduction gear comprises a harmonic drive or an epicyclic gearing.

72. The steering apparatus according to claim 66, wherein the force applying member comprises a tension member configured to apply a compressive force to the bendable member when placed into tension so as to bend the bendable member in the preferential direction.

73. The steering apparatus according to claim 72, wherein the tension member comprises a tube arranged approximately coaxially with the bendable member.

* * * * *